US010741194B2

(12) United States Patent
Kato et al.

(10) Patent No.: US 10,741,194 B2
(45) Date of Patent: Aug. 11, 2020

(54) SIGNAL PROCESSING APPARATUS, SIGNAL PROCESSING METHOD, SIGNAL PROCESSING PROGRAM

(71) Applicant: NEC Corporation, Minato-ku, Tokyo (JP)

(72) Inventors: Masanori Kato, Tokyo (JP); Akihiko Sugiyama, Tokyo (JP)

(73) Assignee: NEC CORPORATION, Tokyo (JP)

( * ) Notice: Subject to any disclaimer, the term of this patent is extended or adjusted under 35 U.S.C. 154(b) by 151 days.

(21) Appl. No.: 14/782,932

(22) PCT Filed: Mar. 27, 2014

(86) PCT No.: PCT/JP2014/058961
§ 371 (c)(1),
(2) Date: Oct. 7, 2015

(87) PCT Pub. No.: WO2014/168021
PCT Pub. Date: Oct. 16, 2014

(65) Prior Publication Data

US 2016/0055863 A1 Feb. 25, 2016

(30) Foreign Application Priority Data

Apr. 11, 2013 (JP) ..... 2013-083411

(51) Int. Cl.
*G10L 19/02* (2013.01)
*G10L 21/0232* (2013.01)
(Continued)

(52) U.S. Cl.
CPC ..... *G10L 21/0232* (2013.01); *G10L 21/034* (2013.01); *G10L 21/0332* (2013.01)

(58) Field of Classification Search
CPC ..... G10L 21/0232; G10L 21/0332; G10L 21/034
(Continued)

(56) References Cited

U.S. PATENT DOCUMENTS 6,122,384 A 9/2000 Mauro
2004/0049383 A1 3/2004 Kato et al.
(Continued)

FOREIGN PATENT DOCUMENTS

CN 101627428 A 1/2010
CN 102549659 A 7/2012
(Continued)

OTHER PUBLICATIONS

Masanori Kato et al., Noise Suppression with High Speech Quality Based on Weighted Noise Estimation and MMSE STSA, Electronics and Communications in Japan, Part 3, vol. 89, No. 2, Jan. 1, 2006, pp. 43-53, XP-001236340.
(Continued)

*Primary Examiner* — Thierry L Pham

(57) ABSTRACT

This invention provides a signal processing apparatus for changing an input sound into an easy-to-hear sound. The signal processing apparatus includes a transformer that transforms an input signal into an amplitude component signal in a frequency domain, a stationary component estimator that estimates a stationary component signal having a frequency spectrum with a stationary characteristic based on the amplitude component signal in the frequency domain, a replacement unit that generates a new amplitude component signal using the amplitude component signal obtained by the transformer and the stationary component signal, and replaces the amplitude component signal by the new amplitude component signal, and an inverse transformer that inversely transforms the new amplitude component signal into an enhanced signal.

7 Claims, 33 Drawing Sheets

(51) Int. Cl.
*G10L 21/034* (2013.01)
*G10L 21/0332* (2013.01)
*G10L 21/00* (2013.01)

(58) Field of Classification Search
USPC ..... 704/203, 205, 269, 500
See application file for complete search history.

(56) References Cited

U.S. PATENT DOCUMENTS

| | | | | |
|---|---|---|---|---|
| 2004/0185804 | A1* | 9/2004 | Kanamori | H04R 3/005 455/114.2 |
| 2006/0271362 | A1 | 11/2006 | Kato et al. | |
| 2010/0014681 | A1* | 1/2010 | Sugiyama | G10L 21/00 381/56 |
| 2010/0296665 | A1 | 11/2010 | Ishikawa et al. | |
| 2011/0081026 | A1* | 4/2011 | Ramakrishnan | G10L 21/0208 381/94.3 |
| 2012/0288116 | A1 | 11/2012 | Saito | |
| 2013/0010974 | A1 | 1/2013 | Nakadai et al. | |
| 2013/0246056 | A1 | 9/2013 | Sugiyama | |

FOREIGN PATENT DOCUMENTS

| | | | |
|---|---|---|---|
| JP | 2002-204175 | A | 7/2002 |
| JP | 2003-058186 | A | 2/2003 |
| JP | 2004-187283 | A | 7/2004 |
| JP | 2006-337415 | A | 12/2006 |
| JP | 2009-055583 | A | 3/2009 |
| JP | 2010-271411 | A | 12/2010 |
| JP | 2012-239017 | A | 12/2012 |
| JP | 2013-020252 | A | 1/2013 |
| WO | 2008/111462 | A1 | 9/2008 |
| WO | 2011/041738 | A2 | 4/2011 |
| WO | 2012/070668 | A1 | 5/2012 |

OTHER PUBLICATIONS

Extended European Search Report for EP Application No. EP14783172.1 dated Nov. 23, 2016.
M. Kato et al., "Noise suppression with high speech quality based on weighted noise estimation and MMSE STSA," IEICE Trans. Fundamentals (Japanese Edition), Jul. 2004, pp. 851-860, vol. J87-A, No. 7, IEICE, Japan, Cited in the Specification.
R. Martin, "Spectral subtraction based on minimum statistics," EUSPICO-94, Sep. 1994, pp. 1182-1185, Aachen, Germany, Cited in the Specification.
"IEEE Transactions on Acoustics, Speech, and Signal Processing", Dec. 1984, pp. 1109-1121, vol. 32, No. 6, IEEE, NJ, USA, Cited in the Specification.
3GPP TS 26.094 V5.0.0 (Jun. 2002), "Technical Specification Group Services and System Aspects; Mandatory speech codec speech processing functions; Adaptive Multi-Rate (AMR) speech codec;Voice Activity Detector (VAD) (Release 5)", Jun. 2002, Valbonne, France, Cited in the Specification.
3GPP TS 26.194 V5.0.0 (Mar. 2001), "Technical Specification Group Services and System Aspects; Speech Codec speech processing functions; AMR Wideband speech codec; Voice Activity Detector (VAD) (Release 5)", Mar. 2001, Valbonne, France, Cited in the Specification.
S. Nordholm et al., "Statistical Voice Activity Detection Using Low-Variance Spectrum Estimation and an Adaptive Threshold", IEEE Transactions on Audio, Speech, and Language Processing, Mar. 2006, pp. 412-424, vol. 14, No. 2, IEEE, NJ, USA, Cited in the Specification.
K. Li et al., "An Improved Voice Activity Detection Using Higher Order Statistics," IEEE Transactions on Speech and Audio Processing, Sep. 2005, pp. 965-974, vol. 13, No. 5, IEEE, NJ, USA, Cited in the Specification.
Shingo Kuroiwa et al., "Wind Noise Reduction Method Using the Observed Spectrum Fine Structure and Estimated Spectrum Envelope", 2006 International Conference on Communication Technology, Jan. 1, 2007, pp. 1-12, vol. J90-A, No. 1, IEEE, NJ, USA, Cited in ISR.
International Search Report for PCT Application No. PCT/JP2014/058961, dated Jul. 1, 2014.
Sugiyama, "Single-Channel Impact-Noise Suppression With no Auxiliary Information for its Detection", 2007 IEEE Workshop on Applications of Signal Processing to Audio and Acoustics, Dec. 2007, pp. 127-130. (Cited in JPOA).
Japanese Office Action for JP Application No. 2015-511204 dated Apr. 3, 2018 with English Translation.
Chinese Office Action for CN Application No. 201480020786.1 dated Jun. 26, 2018 with English Translation.
Chinese Office Action for CN Application No. 201480020786.1 dated Mar. 1, 2019 with English Translation.

* cited by examiner

SIGNAL PROCESSING APPARATUS, SIGNAL PROCESSING METHOD, SIGNAL PROCESSING PROGRAM

This application is a National Stage Entry of PCT/JP2014/058961 filed on Mar. 27, 2014, which claims priority from Japanese Patent Application JP2013-083411 filed on Apr. 11, 2013, the contents of all of which are incorporated herein by reference, in their entirety.

TECHNICAL FIELD

The present invention relates to a technique of suppressing noise with a non-stationary component.

BACKGROUND ART

In the above technical field, patent literature 1 discloses a technique of reducing wind noise by separating an input acoustic signal into low, middle, and high bands. In patent literature 1, a restored signal in the low band is generated from a middle-band component, a modified acoustic signal for the low band is generated by weighted sum of the restored signal and the original low-band signal, and a modified acoustic signal for the middle band is generated by reducing the signal level of the middle-band component. Lastly, the original high-band signal and each of the modified acoustic signals for the low and middle bands are combined to generate an enhanced signal.

Patent literature 2 discloses a technique of separating an input sound into low and high bands, and suppressing wind noise included in a low-band noisy speech signal in accordance with the probability of wind noise.

CITATION LIST

Patent Literature

Patent literature 1: Japanese Patent Laid-Open No. 2009-55583

Patent literature 2: Japanese Patent Laid-Open No. 2012-239017

Patent literature 3: International Publication No. 2012/070668

Non-Patent Literature

Non-patent literature 1: M. Kato, A. Sugiyama, and M. Serizawa, "Noise suppression with high speech quality based on weighted noise estimation and MMSE STSA," IEICE Trans. Fundamentals (Japanese Edition), vol. J87-A, no. 7, pp. 851-860, July 2004.

Non-patent literature 2: R. Martin, "Spectral subtraction based on minimum statistics," EUSPICO-94, pp. 1182-1185, September 1994

Non-patent literature 3: IEEE TRANSACTIONS ON ACOUSTICS, SPEECH, AND SIGNAL PROCESSING, VOL. 32, NO. 6, PP. 1109-1121, December 1984

Non-patent literature 4: 3GPP Technical Specification 26.094, vol. 5.0.0, June 2002.

Non-patent literature 5: 3GPP Technical Specification 26.194, vol. 5.0.0, March 2001.

Non-patent literature 6: A. Davis, S. Nordholm, R. Togneri, "Statistical Voice Activity Detection Using Low-Variance Spectrum Estimation and an Adaptive Threshold," IEEE TRANSACTIONS ON AUDIO, SPEECH, AND LANGUAGE PROCESSING, vol. 14, no. 2, pp. 412-424, March 2006.

Non-patent literature 7: K. Li, M. N. S. Swamy, M. O. Ahmad, "An Improved Voice Activity Detection Using Higher Order Statistics," IEEE TRANSACTIONS ON SPEECH AND AUDIO PROCESSING, vol. 13, no. 5, pp. 965-974, September 2005.

SUMMARY OF THE INVENTION

Technical Problem

Either of the techniques described in patent literatures 1 and 2, however, simply suppresses wind noise by reducing the signal level of a speech signal in the low band, and is not an effective method as a method of suppressing non-stationary noise like wind noise. As a result, it is impossible to change an input sound into an easy-to-hear sound.

The present invention enables to provide a technique of solving the above-described problem.

Solution to Problem

One aspect of the present invention provides a signal processing apparatus comprising:

a transformer that transforms an input signal into an amplitude component signal in a frequency domain;

a stationary component estimator that estimates a stationary component signal having a frequency spectrum with a stationary characteristic based on the amplitude component signal in the frequency domain;

a replacement unit that generates a new amplitude component signal using the amplitude component signal obtained by the transformer and the stationary component signal, and replaces the amplitude component signal by the new amplitude component signal; and an inverse transformer that inversely transforms the new amplitude component signal into an enhanced signal.

Another aspect of the present invention provides a signal processing method comprising:

transforming an input signal into an amplitude component signal in a frequency domain;

estimating a stationary component signal having a frequency spectrum with a stationary characteristic based on the amplitude component signal in the frequency domain;

generating a new amplitude component signal using the amplitude component signal obtained in the transform and the stationary component signal, and replacing the amplitude component signal by the new amplitude component signal; and inversely transforming the new amplitude component signal into an enhanced signal.

Still other aspect of the present invention provides a signal processing program for causing a computer to execute a method, comprising:

transforming an input signal into an amplitude component signal in a frequency domain;

estimating a stationary component signal having a frequency spectrum with a stationary characteristic based on the amplitude component signal in the frequency domain;

generating a new amplitude component signal using the amplitude component signal obtained in the transform and the stationary component signal, and replacing the amplitude component signal by the new amplitude component signal; and inversely transforming the new amplitude component signal into an enhanced signal.

Advantageous Effects of Invention

According to the present invention, it is possible to change an input sound into an easy-to-hear sound.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise. Note that "speech signal" in the following explanation indicates a direct electrical change that occurs in accordance with the influence of speech or another sound. The speech signal transmits speech or another sound and is not limited to speech.

First Embodiment

Figure 1:
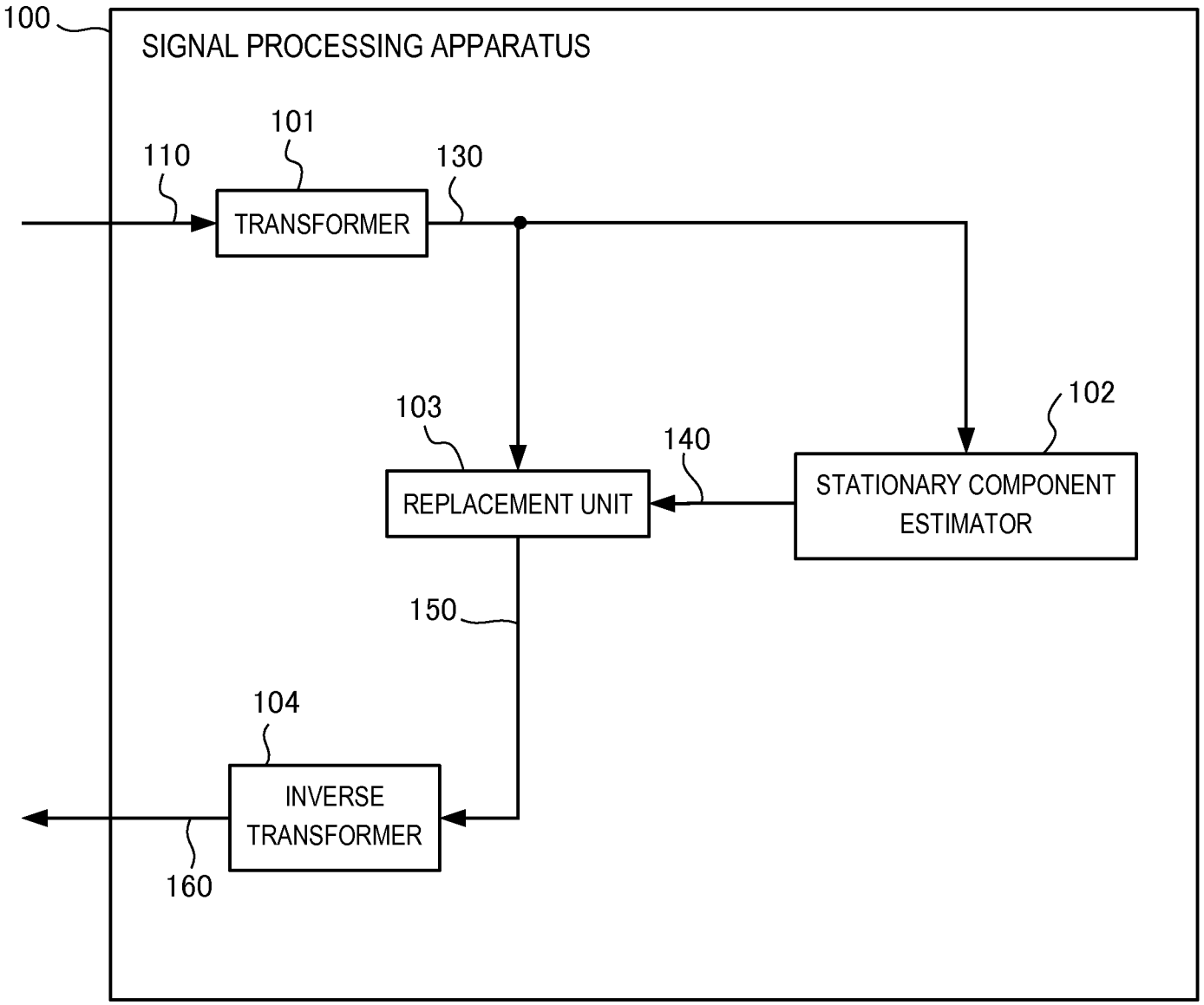
FIG. 1 is a block diagram showing the arrangement of a signal processing apparatus according to the first embodiment of the present invention.

A signal processing apparatus 100 according to the first embodiment of the present invention will be described with reference to FIG. 1. As shown in FIG. 1, the signal processing apparatus 100 includes a transformer 101, a stationary component estimator 102, a replacement unit 103, and an inverse transformer 104.

The transformer 101 transforms an input signal 110 into an amplitude component signal 130 in a frequency domain.

The stationary component estimator 102 estimates a stationary component signal 140 having a frequency spectrum with a stationary characteristic based on the amplitude component signal 130 in the frequency domain. The replacement unit 103 generates a new amplitude component signal 150 using the amplitude component signal 130 and the stationary component signal 140, and replaces the amplitude component signal 130 by the new amplitude component signal 150. The inverse transformer 104 inversely transforms the new amplitude component signal 150 into an enhanced signal 160.

With the above arrangement, it is possible to suppress unpleasant non-stationary noise by replacing noise included in an input sound by stationary, easy-to-hear noise.

Second Embodiment

<<Overall Arrangement>>

A signal processing apparatus according to the second embodiment of the present invention will be described with reference to the accompanying drawings. The signal processing apparatus according to this embodiment, for example, appropriately suppresses non-stationary noise like wind noise. Simply speaking, in the frequency domain, a stationary component in an input sound is estimated, and part or all of the input sound is replaced by the estimated stationary component. The input sound is not limited to speech. For example, an environmental sound (noise on the street, the traveling sound of a train/car, an alarm/warning sound, a clap, or the like), a person's voice or animal's sound (chirping of a bird, barking of a dog, mewing of a cat, laughter, a tearful voice, a cheer, or the like), music, or the like may be used as an input sound. Note that speech is exemplified as a representative example of the input sound in this embodiment.

Figure 2A:
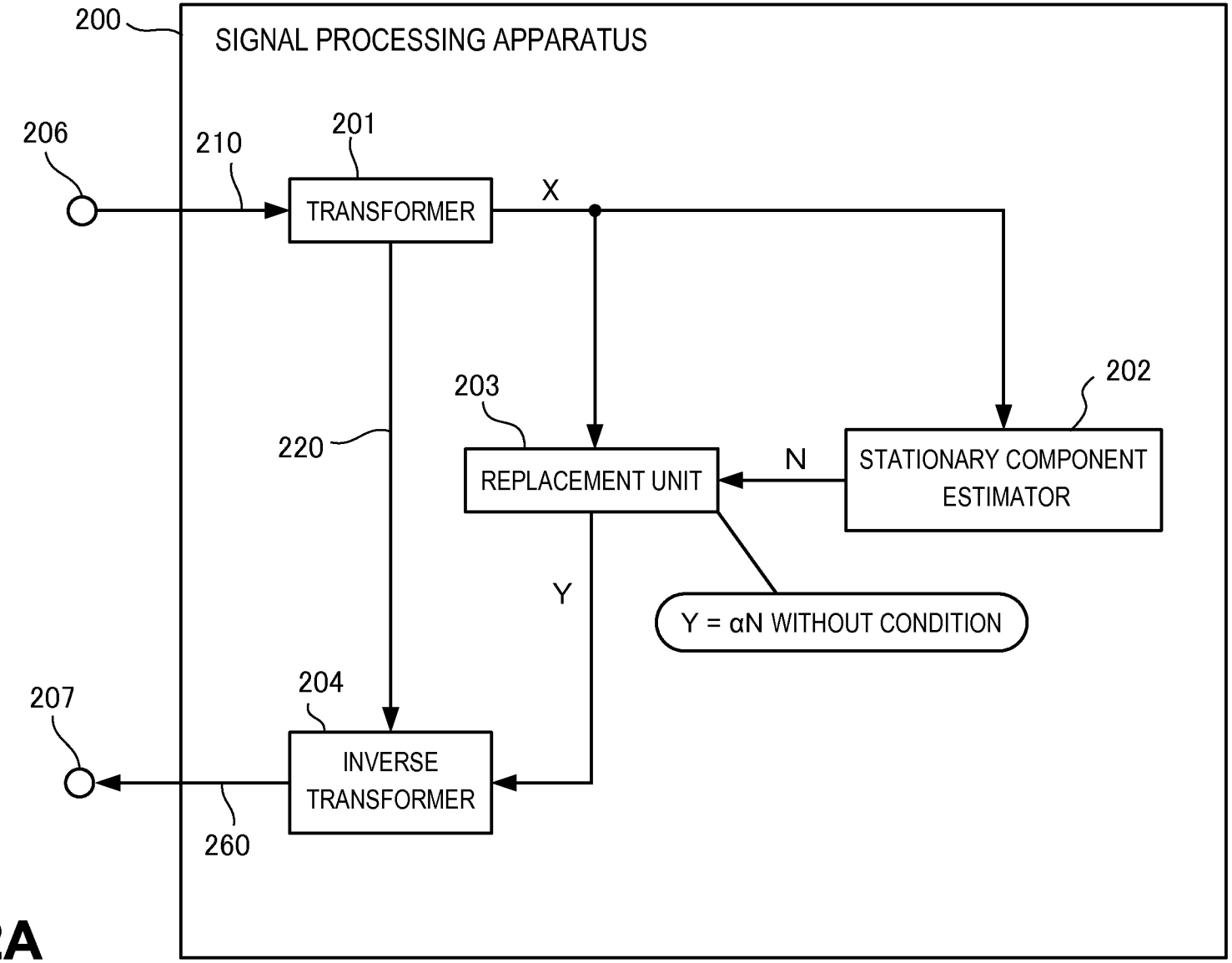
FIG. 2A is block diagram showing the arrangement of a signal processing apparatus according to the second embodiment of the present invention.

FIG. 2A is a block diagram showing the overall arrangement of a signal processing apparatus 200. A noisy signal (a signal including both a desired signal and noise) is supplied to an input terminal 206 as a series of sample values. The noisy signal supplied to the input terminal 206 undergoes transform such as Fourier transform in a transformer 201 and is divided into a plurality of frequency components. The plurality of frequency components are independently processed on a frequency basis. The description will be continued here by paying attention to a specific frequency component. Out of the frequency component, an amplitude spectrum (amplitude component) $|X(k, n)|$ is supplied to a stationary component estimator 202 and a replacement unit 203, and a phase spectrum (phase component) 220 is supplied to an inverse transformer 204. Note that the transformer 201 supplies the noisy signal amplitude spectrum $|X(k, n)|$ to the stationary component estimator 202 and the replacement unit 203 here. However, the present invention is not limited to this, and a power spectrum corresponding to the square of the amplitude spectrum may be supplied.

The stationary component estimator 202 estimates a stationary component included in the noisy signal amplitude spectrum $|X(k, n)|$ supplied from the transformer 201, and generates a stationary component signal (stationary component spectrum) $N(k, n)$.

The replacement unit 203 replaces the noisy signal amplitude spectrum $|X(k, n)|$ supplied from the transformer 201 using the generated stationary component spectrum $N(k, n)$, and transmits an enhanced signal amplitude spectrum $|Y(k, n)|$ to the inverse transformer 204 as a replacement result.

The inverse transformer 204 inversely transforms the enhanced signal phase spectrum $|Y(k, n)|$ supplied from the replacement unit 203 into a resultant signal by compositing the noisy signal phase spectrum 220 supplied from the transformer 201, and supplies the resultant signal to an output terminal 207 as an enhanced signal.

<<Arrangement of Transformer>>

Figure 2B:
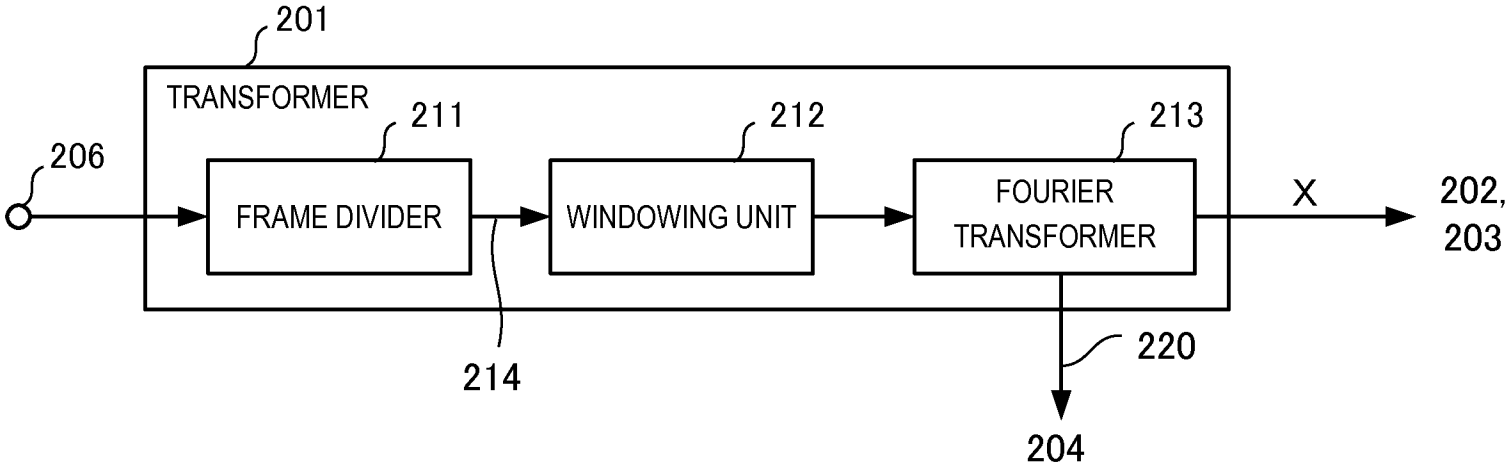
FIG. 2B is a block diagram showing the arrangement of a transformer according to the second embodiment of the present invention.

FIG. 2B is a block diagram showing the arrangement of the transformer 201. As shown in FIG. 2B, the transformer 201 includes a frame divider 211, a windowing unit 212, and a Fourier transformer 213. A noisy signal sample is supplied to the frame divider 211 and divided into frames on the basis of K/2 samples, where K is an even number. The noisy signal sample divided into frames is supplied to the windowing unit 212 and multiplied by a window function w(t). The signal obtained by windowing an n-th frame input signal x(t, n) (t=0, 1, . . . , K/2−1) by w(t) is given by $$\bar{x}(t,n)+w(t)x(t,n) \tag{1}$$

Two successive frames may partially be overlaid (overlapped) and windowed. Assume that the overlap length is 50% the frame length. For t=0, 1, . . . , K−1, the windowing unit 212 outputs the left-hand sides of $$\bar{x}(t, n) = \begin{cases} w(t)x(t, n-1), & 0 \le t < K/2 \\ w(t)x(t, n), & K/2 \le t < K \end{cases} \tag{2}$$

A symmetric window function is used for a real signal. The window function is designed to make the input signal and the output signal match with each other except a calculation error when the output of the transformer 201 is directly supplied to the inverse transformer 204. This means $w^2(t)+w^2(t+K/2)=1$.

The description will be continued below assuming an example in which windowing is performed for two successive frames that overlap 50%. As w(t), the windowing unit can use, for example, a Hanning window given by $$w(t) = \begin{cases} 0.5 + 0.5\cos\left(\frac{\pi(t-K/2)}{K/2}\right), & 0 \le t < K \\ 0, & \text{otherwise} \end{cases} \tag{3}$$

Various window functions such as a Hamming window and a triangle window are also known. The windowed output is supplied to the Fourier transformer 213 and transformed into a noisy signal spectrum X(k, n). The noisy signal spectrum X(k, n) is separated into the phase and the amplitude. A noisy signal phase spectrum argX(k, n) is supplied to the inverse transformer 204, whereas the noisy signal amplitude spectrum $|X(k, n)|$ is supplied to the stationary component estimator 202 and the replacement unit 203. As already described, a power spectrum may be used in place of the amplitude spectrum.

<<Arrangement of Inverse Transformer>>

Figure 2C:
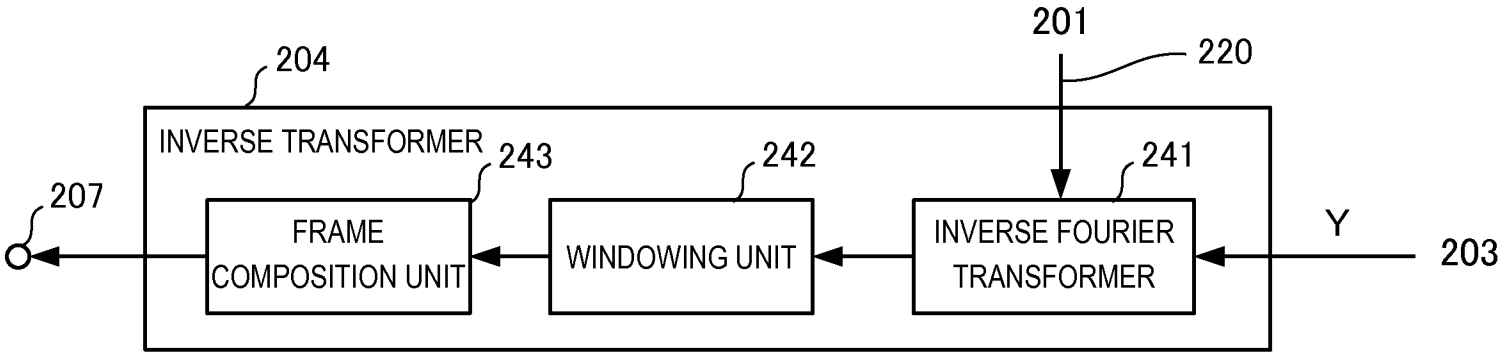
FIG. 2C is a block diagram showing the arrangement of an inverse transformer according to the second embodiment of the present invention.

FIG. 2C is a block diagram showing the arrangement of the inverse transformer 204. As shown in FIG. 2C, the inverse transformer 204 includes an inverse Fourier transformer 241, a windowing unit 242, and a frame composition unit 243. The inverse Fourier transformer 241 obtains an enhanced signal spectrum Y(k, n) using the enhanced signal amplitude spectrum $|Y(k, n)|$ (represented by Y in FIG. 2C) supplied from the replacement unit 203 and the noisy signal phase spectrum 220 (argX(k, n)) supplied from the transformer 201 as follows.

$$Y(k,n)=|Y(k,n)|\cdot\exp(j\arg X(k,n)) \tag{4}$$

where j represents an imaginary unit.

Inverse Fourier transform is performed for the obtained enhanced signal spectrum. The signal is supplied to the windowing unit 242 as a series of time domain sample values y(t, n) (t=0, 1, . . . , K−1) in which one frame includes K samples, and multiplied by the window function w(t). A signal obtained by windowing an nth frame enhanced signal y(t, n) (t=0, 1, . . . , K−1) by w(t) is given by the left-hand side of $$\bar{y}(t,n)=w(t)y(t,n) \tag{5}$$

The frame composition unit 243 extracts the outputs of two adjacent frames from the windowing unit 242 on the basis of K/2 samples, overlays them, and obtains an output signal (the left-hand side of equation (6)) for t=0, 1, . . . , K/2-1 by $$\hat{y}(t,n)=\bar{y}(t+K/2,n-1)+\bar{y}(t,n) \tag{6}$$

An obtained output signal 260 is transmitted from the frame composition unit 243 to the output terminal 207.

Note that the transform in the transformer 201 and the inverse transformer 204 in FIGS. 2B and 2C have been described as Fourier transform. However, any other transform such as Hadamard transform, Haar transform, or Wavelet transform may be used in place of the Fourier transform. Haar transform does not need multiplication and can reduce the area of an LSI chip. Wavelet transform can change the time resolution depending on the frequency and is therefore expected to improve the noise suppression effect.

The stationary component estimator 202 can estimate a stationary component after a plurality of frequency components obtained by the transformer 201 are integrated. The number of frequency components after integration is smaller than that before integration. More specifically, a stationary component spectrum common to an integrated frequency component obtained by integrating frequency components is obtained and commonly used for the individual frequency components belonging to the same integrated frequency component. As described above, when a stationary component signal is estimated after a plurality of frequency components are integrated, the number of frequency components to be applied becomes small, thereby reducing the total calculation amount.

(Definition of Stationary Component Spectrum)

The stationary component spectrum indicates a stationary component included in the input signal amplitude spectrum. A temporal change in power of the stationary component is smaller than that of the input signal. The temporal change is generally calculated by a difference or ratio. If the temporal change is calculated by a difference, when an input signal amplitude spectrum and a stationary component spectrum are compared with each other in a given frame n, there is at least one frequency k which satisfies $$(|N(k,n-1)|-|N(k,n)|)^2<(|X(k,n-1)|-|X(k,n)|)^2 \tag{7}$$

Alternatively, if the temporal change is calculated by a ratio, there is at least one frequency k which satisfies $$\frac{|N(k,n-1)|}{|N(k,n)|}<\frac{|X(k,n-1)|}{|X(k,n)|} \tag{8}$$

That is, if the left-hand side of the above expression is always higher than the right-hand side for all the frames n and frequencies k, it can be defined that N(k, n) is not a stationary component spectrum. Even if the functions are the indices, logarithms, or powers of X and N, the same definition can be given.

(Method of Deriving Stationary Component Spectrum)

Various estimation methods such as the methods described in non-patent literatures 1 and 2 can be used to estimate a stationary component spectrum.

For example, non-patent literature 1 discloses a method of obtaining, as an estimated noise spectrum, the average value of noisy signal amplitude spectra of frames in which no target sound is included. In this method, it is necessary to detect the target sound. A section where the target sound is included can be determined by the power of the enhanced signal.

As an ideal operation state, the enhanced signal is the target sound other than noise. In addition, the level of the target sound or noise does not largely change between adjacent frames. For these reasons, the enhanced signal level of an immediately preceding frame is used as an index to determine a noise section. If the enhanced signal level of the immediately preceding frame is equal to or smaller than a predetermined value, the current frame is determined as a noise section. A noise spectrum can be estimated by averaging the noisy signal amplitude spectra of frames determined as a noise section.

Non-patent literature 1 also discloses a method of obtaining, as an estimated noise spectrum, the average value of noisy signal amplitude spectra in the early stage in which supply of them has started. In this case, it is necessary to meet a condition that the target sound is not included immediately after the start of estimation. If the condition is met, the noisy signal amplitude spectrum in the early stage of estimation can be obtained as the estimated noise spectrum.

Non-patent literature 2 discloses a method of obtaining an estimated noise spectrum from the minimum value (minimum statistic) of the noisy signal amplitude spectrum. In this method, the minimum value of the noisy signal amplitude spectrum within a predetermined time is held, and a noise spectrum is estimated from the minimum value. The minimum value of the noisy signal amplitude spectrum is similar to the shape of a noise spectrum and can therefore be used as the estimated value of the noise spectrum shape. However, the minimum value is smaller than the original noise level. Hence, a spectrum obtained by appropriately amplifying the minimum value is used as an estimated noise spectrum.

In addition, an estimated noise spectrum may be obtained using a median filter. An estimated noise spectrum may be obtained by WiNE (Weighted Noise Estimation) as a noise estimation method of following changing noise by using the characteristic in which noise slowly changes.

The thus obtained estimated noise spectrum can be used as a stationary component spectrum.

(Spectrum Shape)

Figure 3:
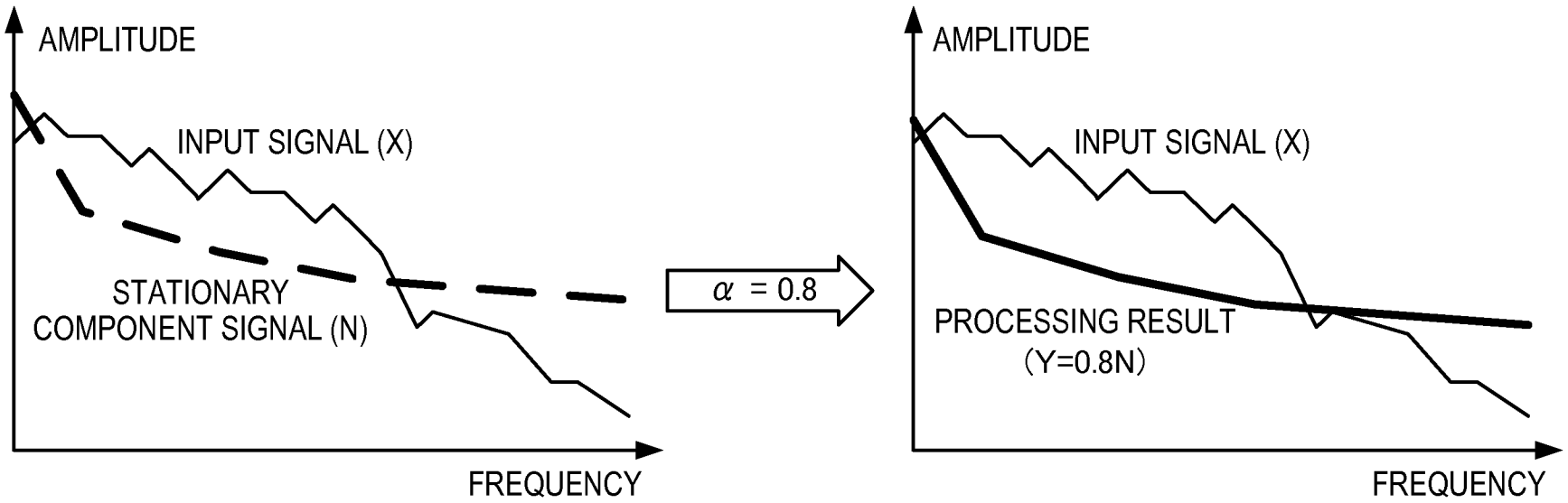
FIG. 3 is a view showing a signal processing result by the signal processing apparatus according to the second embodiment of the present invention.

FIG. 3 is a view showing the relationship between the noisy signal amplitude spectrum (to be also referred to as an input signal hereinafter) |X(k, n)|, the stationary component spectrum (stationary component signal) N(k, n), and the enhanced signal amplitude spectrum (to be referred to as a processing result hereinafter) |Y(k, n)| at given time n. In FIG. 3, these spectra are represented by X, N, and Y, respectively. In this embodiment, at all the frequencies, the input signal |X(k, n)| is replaced by α(k, n)N(k, n) obtained by multiplying the stationary component signal N(k, n) by a predetermined coefficient α(k, n). FIG. 3 shows an example in which α(k, n)=0.8 is set.

A function of obtaining an amplitude spectrum (replacement amplitude spectrum) used for replacement is not limited to a linear mapping function of N(k, n) represented by $\alpha(k, n)N(k, n)$. For example, a linear function such as $\alpha(k, n)N(k, n)+C(k, n)$ can be adopted. In this case, if $C(k, n)>0$, the level of the replacement amplitude spectrum can be improved as a whole, thereby improving the stationarity at the time of hearing. If $C(k, n)<0$, the level of the replacement amplitude spectrum can be decreased as a whole but it is necessary to adjust C(k, n) so a band in which the value of the spectrum becomes negative does not appear. In addition, the function of the stationary component spectrum N(k, n) represented in another form such as a high-order polynomial function or nonlinear function can be used.

Figure 4:
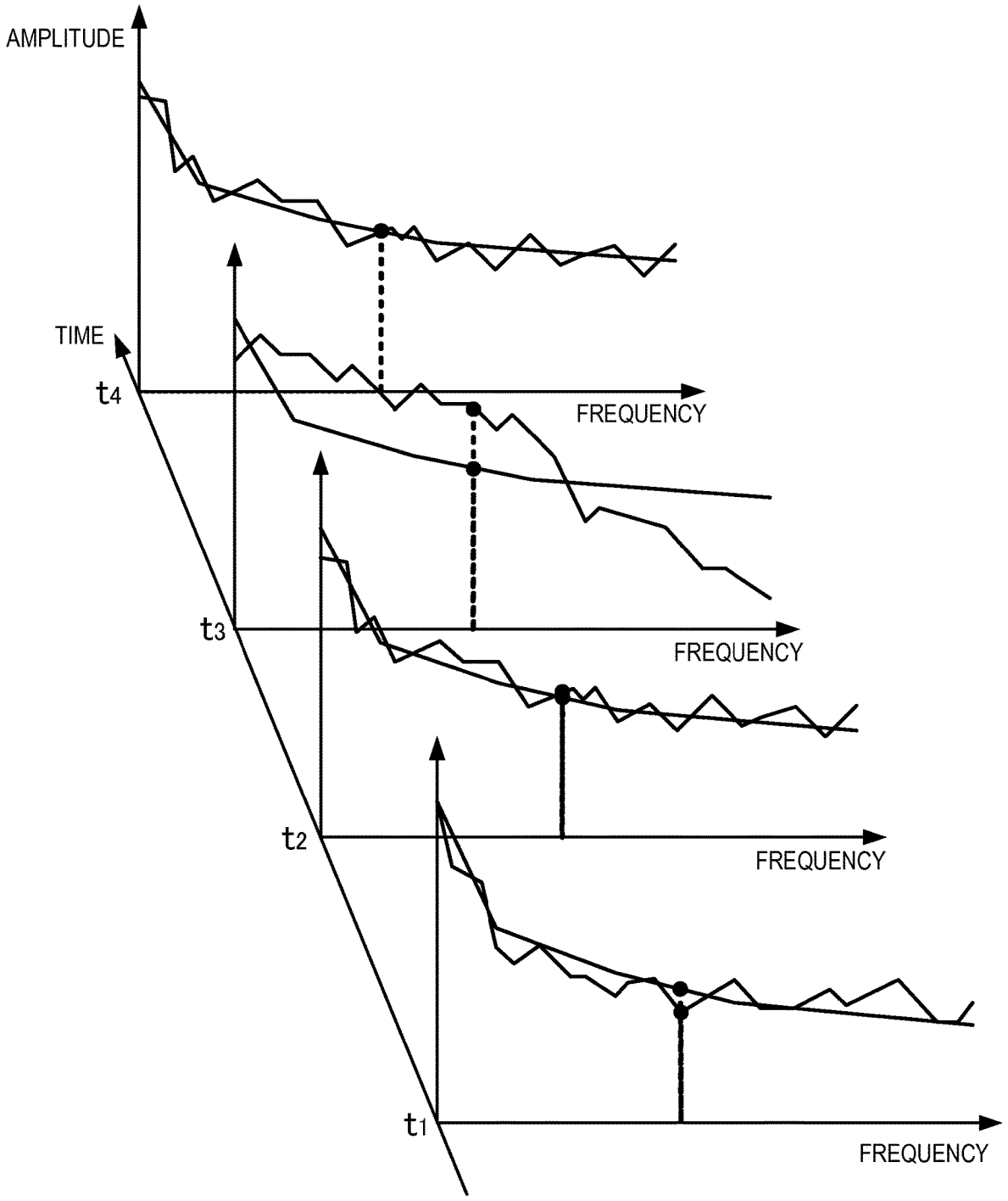
FIG. 4 is a view showing the signal processing result by the signal processing apparatus according to the second embodiment of the present invention.

FIG. 4 is a view showing changes in noisy signal amplitude spectrum, enhanced signal amplitude spectrum, and stationary component amplitude spectrum with time in accordance with the frequency. As shown in FIG. 4, by continuously representing the frequency spectra of the input signal $|X(k, n)|$ and stationary component signal N(k, n) at a plurality of times, it is possible to understand temporal changes in amplitude spectra.

Figure 5:
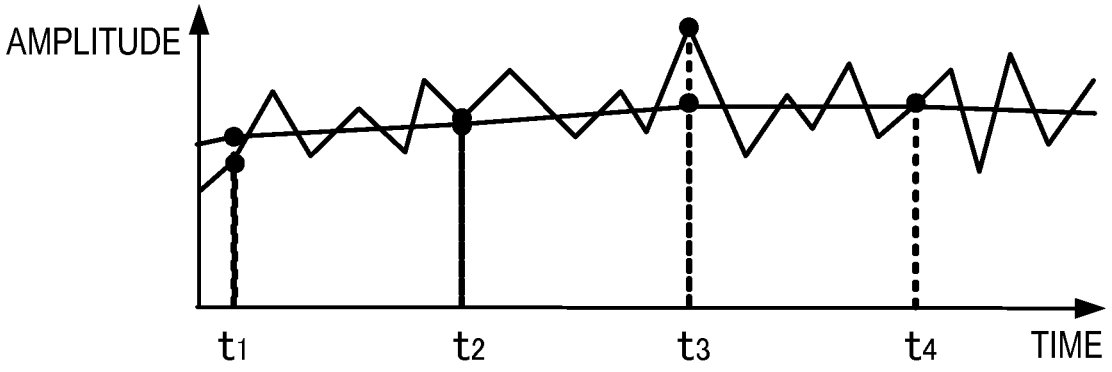
FIG. 5 is a timing chart showing the signal processing result by the signal processing apparatus according to the second embodiment of the present invention.

FIG. 5 is a timing chart showing temporal changes in noisy signal amplitude spectrum, enhanced signal amplitude spectrum to be output, and stationary component spectrum at a given frequency. As shown in FIG. 5, it is possible to make the temporal change in amplitude spectrum stationary by replacing the input signal $|X(k, n)|$ by the multiple of the coefficient $\alpha(k, n)$ of the stationary component signal N(k, n). That is, in this embodiment, it is possible to prevent a "spike" of the amplitude component in the frequency domain by replacing the input signal amplitude spectrum $|X(k, n)|$ by a spectrum which at least stationarily changes in the time direction. This can suppress noise with a strong non-stationary component such as wind noise which cannot be suppressed only by smoothing the component only in the time domain. It is possible to change noise into an easy-to-hear sound by making the noise component stationary in the frequency domain instead of decreasing the noise component.

Since the non-stationarity of wind noise is high, if it is attempted to estimate wind noise, the accuracy decreases, and the conventional noise estimation method cannot cope with wind noise. However, when a stationary component signal is generated by, for example, performing averaging in the frequency direction, and used to perform replacement, it is possible to change wind noise into a sound which is not unpleasant while ensuring the tracking capability.

(Coefficient $\alpha$)

An empirically appropriate value is determined as the coefficient $\alpha(k, n)$ by which the stationary component signal N(k, n) is multiplied. For example, if $\alpha(k, n)=1$, $|Y(k, n)|=N(k, n)$ is obtained, and thus the stationary component signal N(k, n) is directly used as an output signal to the inverse transformer 104. At this time, if the stationary component signal N(k, n) is large, large noise unwantedly remains. To solve this problem, the coefficient $\alpha(k, n)$ may be determined so that the maximum value of the amplitude component to be output to the inverse transformer 104 is equal to or smaller than a predetermined value. For example, if $\alpha(k, n)=0.5$, replacement is performed by a signal of half the power of the stationary component signal N(k, n). If $\alpha(k, n)=0.1$, the sound becomes small, and has the same spectrum shape as that of the stationary component signal N(k, n).

For example, if an SNR (signal-to-noise ratio) is low, a target sound is small, and thus strong suppression may be performed by decreasing $\alpha(k, n)$. To the contrary, when the SNR is high, noise is small, and thus no replacement may be performed by setting $\alpha(k, n)$ to 1.

In addition, by considering that a sound is unpleasant when the high band is enhanced, a function of making $\alpha(k, n)$ sufficiently small when k is equal to or larger than a threshold, or a monotone decreasing function of k, which becomes smaller as k increases, may be used.

According to this embodiment, since it is possible to make the noise component of the output signal stationary, the sound quality improves, as compared with the conventional techniques. Note that the replacement unit 203 may replace an amplitude component on a sub-band basis in place of a frequency basis.

Third Embodiment

Figure 6:
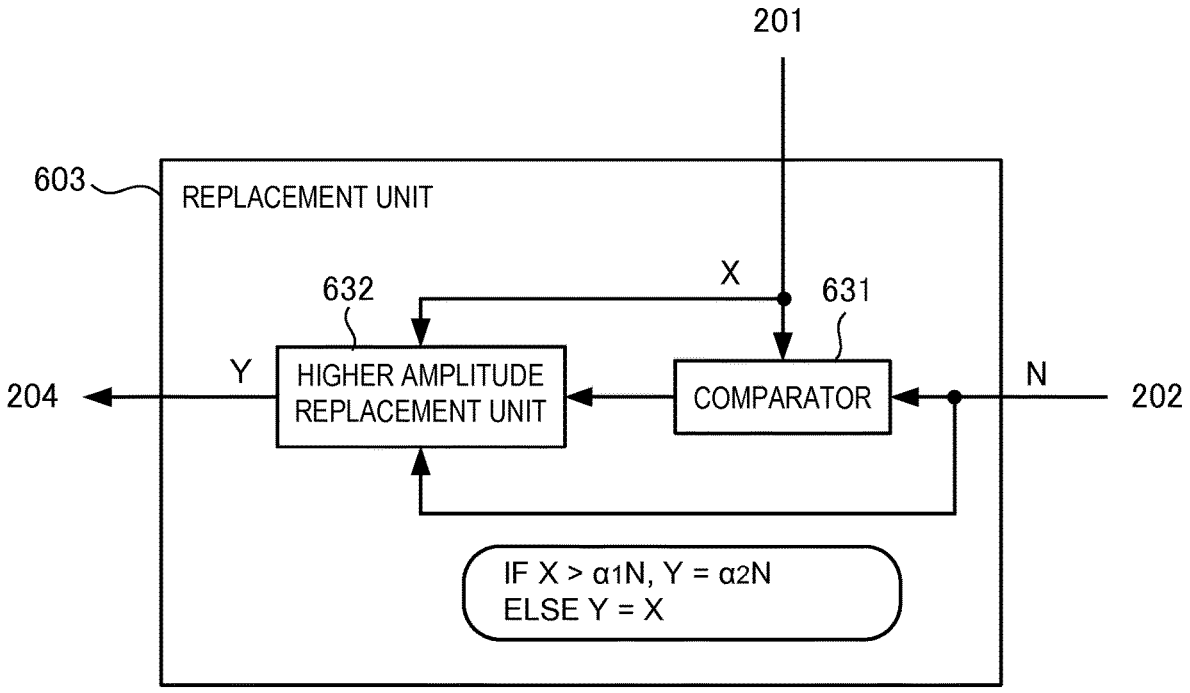
FIG. 6 is a block diagram showing the arrangement of a replacement unit according to the third embodiment of the present invention.

A signal processing apparatus according to the third embodiment of the present invention will be described with reference to FIGS. 6 to 8. FIG. 6 is a block diagram for explaining the arrangement of a replacement unit 603 of the signal processing apparatus according to this embodiment. The replacement unit 603 according to this embodiment is different from the second embodiment in that a comparator 631 and a higher amplitude replacement unit 632 are included. The rest of the components and operations is the same as in the second embodiment. Hence, the same reference numerals denote the same components and operations, and a detailed description thereof will be omitted.

The comparator 631 compares a noisy signal amplitude spectrum $|X(k, n)|$ with a first threshold obtained by calculating a stationary component spectrum N(k, n) by a linear mapping function as the first function. In this embodiment, a case in which comparison is performed with a representative constant multiple among linear mapping functions, that is, a multiple of $\alpha1(k, n)$ will be explained. If the amplitude (power) component $|X(k, n)|$ is larger than the multiple of $\alpha1(k, n)$ of the stationary component signal N(k, n), the higher amplitude replacement unit 632 performs replacement by a replacement amplitude spectrum, that is, the multiple, serving as the second function, of $\alpha2(k, n)$ of the stationary component signal N(k, n); otherwise, the spectrum shape is directly used as an output signal $|Y(k, n)|$ of the replacement unit 603. That is, if $|X(k, n)|>\alpha1(k, n)N(k, n)$, $|Y(k, n)|=\alpha2(k, n)N(k, n)$ is obtained; otherwise, $|Y(k, n)|=|X(k, n)|$ is obtained.

A method of calculating a spectrum to be used for comparison with the noisy signal amplitude spectrum $|X(k, n)|$ is not limited to the method using the linear mapping function of the stationary component spectrum N(k, n). For example, a linear function like $\alpha1(k, n)N(k, n)+C(k, n)$ can be adopted. In this case, if $C(k, n)<0$, a band where replacement is performed by the stationary component signal increases, and it is thus possible to largely suppress unpleasant non-stationary noise. In addition, the function of the stationary component spectrum N(k, n) represented in another form such as a high-order polynomial function or nonlinear function can be used.

Figure 7:
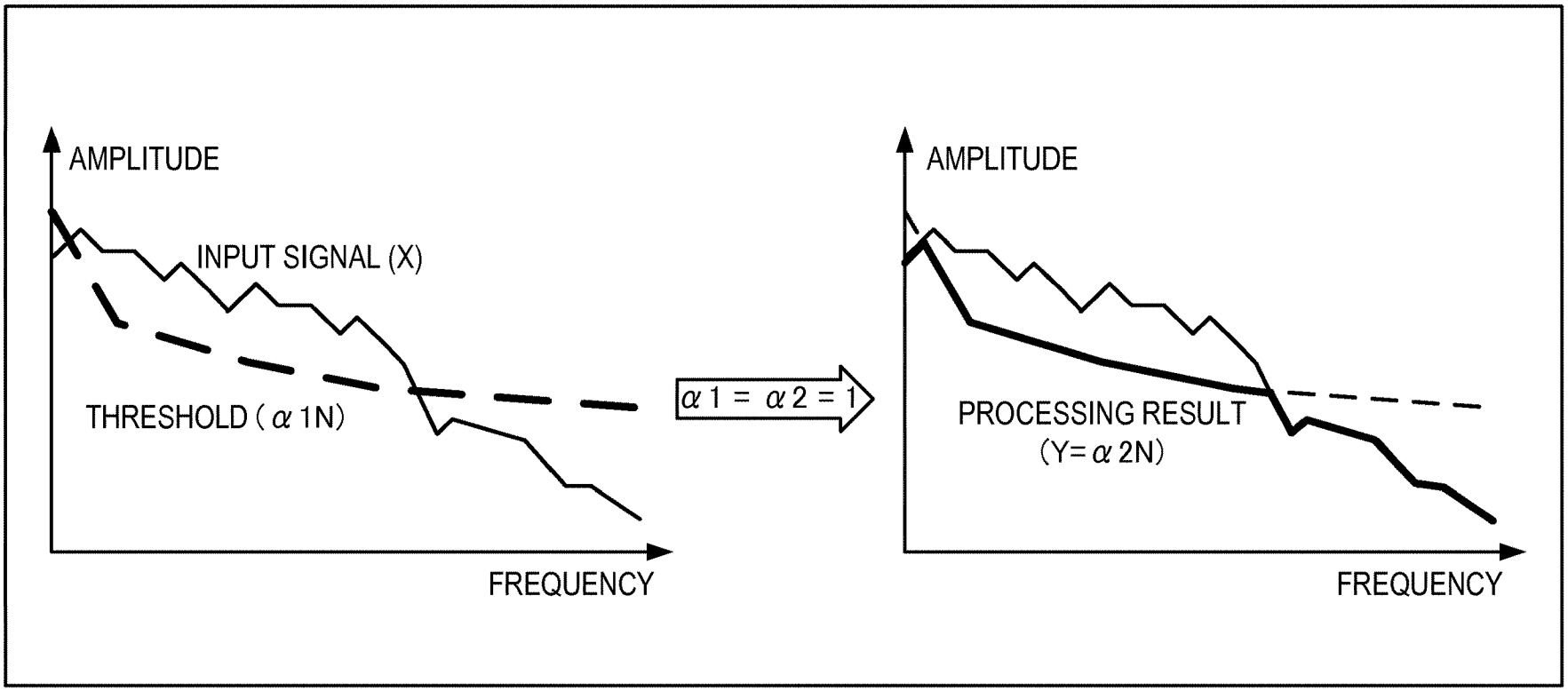
FIG. 7 is a view showing a signal processing result by a signal processing apparatus according to the third embodiment of the present invention.

FIG. 7 is a view showing the relationship between the input signal $|X(k, n)|$, the stationary component signal N(k, n), and the output signal $|Y(k, n)|$ when $\alpha1(k, n)=\alpha2(k, n)=1.0$.

This is effective when a variation in input signal is large in a frequency band in which power is larger than the threshold $\alpha1(k, n)N(k, n)$ obtained by multiplying the stationary component signal by the predetermined coefficient. On the other hand, since it is possible to maintain the naturalness in a band in which power is smaller than the threshold $\alpha1(k, n)N(k, n)$ obtained by multiplying the stationary component signal by the predetermined coefficient, the sound quality improves.

Figure 8:
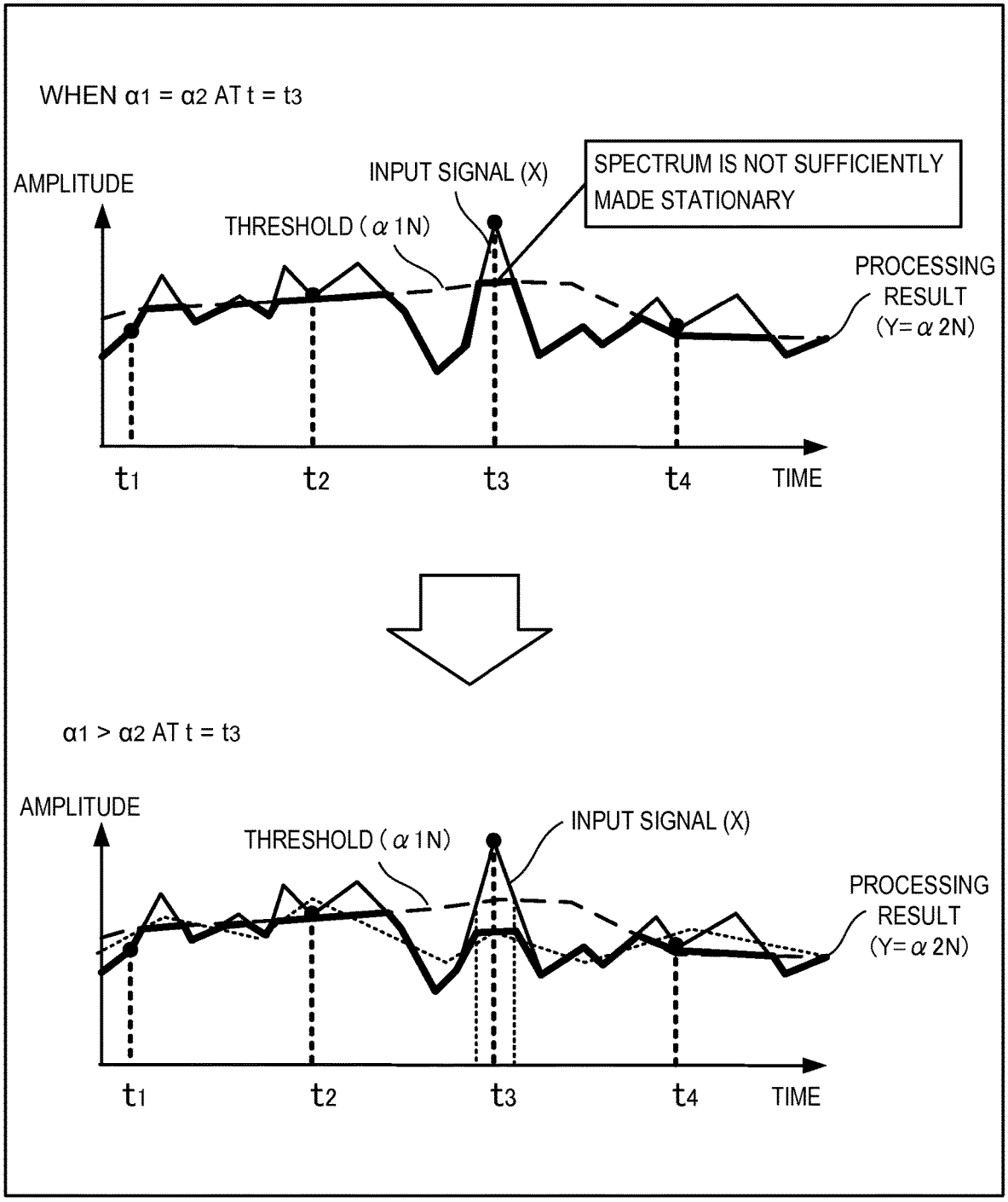
FIG. 8 is a view showing the signal processing result by the signal processing apparatus according to the third embodiment of the present invention.

FIG. 8 is a view showing the relationship between the input signal $|X(k, n)|$, the stationary component signal $N(k, n)$, and the output signal $|Y(k, n)|$ when $\alpha1(k, n)>\alpha2(k, n)$ should hold. As for the input signal $|X(k, n)|$ shown in FIG. 8, if $\alpha1(k, n)=\alpha2(k, n)$, the spectrum is not sufficiently made stationary as shown in a graph in the upper portion, and thus it is impossible to sufficiently suppress noise with a strong non-stationary component like wind noise.

To cope with this, it is possible to replace the spectrum by a spectrum with higher stationarity by setting $\alpha1(k, n)>\alpha2(k, n)$ before and after time t3, as shown in the lower portion of FIG. 8.

At each time, $\alpha2(k, n)$ can be obtained according to a procedure of (1)→(2) below.

(1) A short-time moving average X_bar(k, n) (k and n are indices corresponding to the frequency and time, respectively) of the input signal is calculated in advance by, for example, $|X_bar(k, n)|=(|X(k, n-2)|+|X(k, n-1)|+|X(k, n)|+|X(k, n+1)|+|X(k, n+2)|)/5$. (2) The difference between the short-time moving average ($|X_bar(k, n)|$) and a value ($\alpha2(k, n)-N(k, n)$) after replacement is calculated, and if the difference is large, the value of $\alpha2(k, n)$ is changed to decrease the difference. If the changed value is represented by $\alpha2_hat(k, n)$, the following methods may be used as a change method. (a) $\alpha2_hat(k, n)=0.5\cdot\alpha2(k, n)$ is uniformly set (constant multiplication is performed by a predetermined value). (b) $\alpha2_hat(k, n)=|(X_bar(k, n)|/|N(k, n)|$ is set (calculation is performed using $|X_bar(k, n)|$ and $|N(k, n)|$). (c) $\alpha2_hat(k, n)=0.8\cdot|X_bar(k, n)|/|N(k, n)|+0.2$ is set (same as above).

However, a method of obtaining $\alpha2(k, n)$ is not limited to the above-described one. For example, $\alpha2(k, n)$ which is a constant value regardless of the time may be set in advance. In this case, the value of $\alpha2(k, n)$ may be determined by actually hearing a processed signal. That is, the value of $\alpha2(k, n)$ may be determined in accordance with the characteristics of a microphone and a device to which the microphone is attached.

For example, when the following condition is met, the coefficient $\alpha2(k, n)$ may be obtained by dividing the short-time moving average $|X_bar(k, n)|$ by the stationary component signal $|N(k, n)|$ before and after time n using equations 1 to 3, and the input signal $|X(k, n)|$ may be replaced by the short-time moving average $|X_bar(k, n)|$ as a result. When the following condition is not met, $\alpha2(k, n)=\alpha1(k, n)$ may be set.

$$|X(k,n)|>\alpha1(k,n)\cdot N(k,n) \text{ and } \alpha1(k,n)\cdot N(k,n)-|X_bar(k,n)|>\delta \quad \text{Condition:}$$

$$\alpha2(k,n-1)=|X_bar(k,n)|/N(k,n) \quad \text{Equation 1:}$$

$$\alpha2(k,n)=|X_bar(k,n)|/N(k,n) \quad \text{Equation 2:}$$

$$\alpha2(k,n+1)=|X_bar(k,n)|/N(k,n) \quad \text{Equation 3:}$$

As described above, in the stationary component signal $N(k, n)$, if it is impossible to prevent a "spike" of the amplitude component signal within a short time, it is possible to perform replacement using the short-time moving average, thereby improving the sound quality.

Fourth Embodiment

Figure 9:
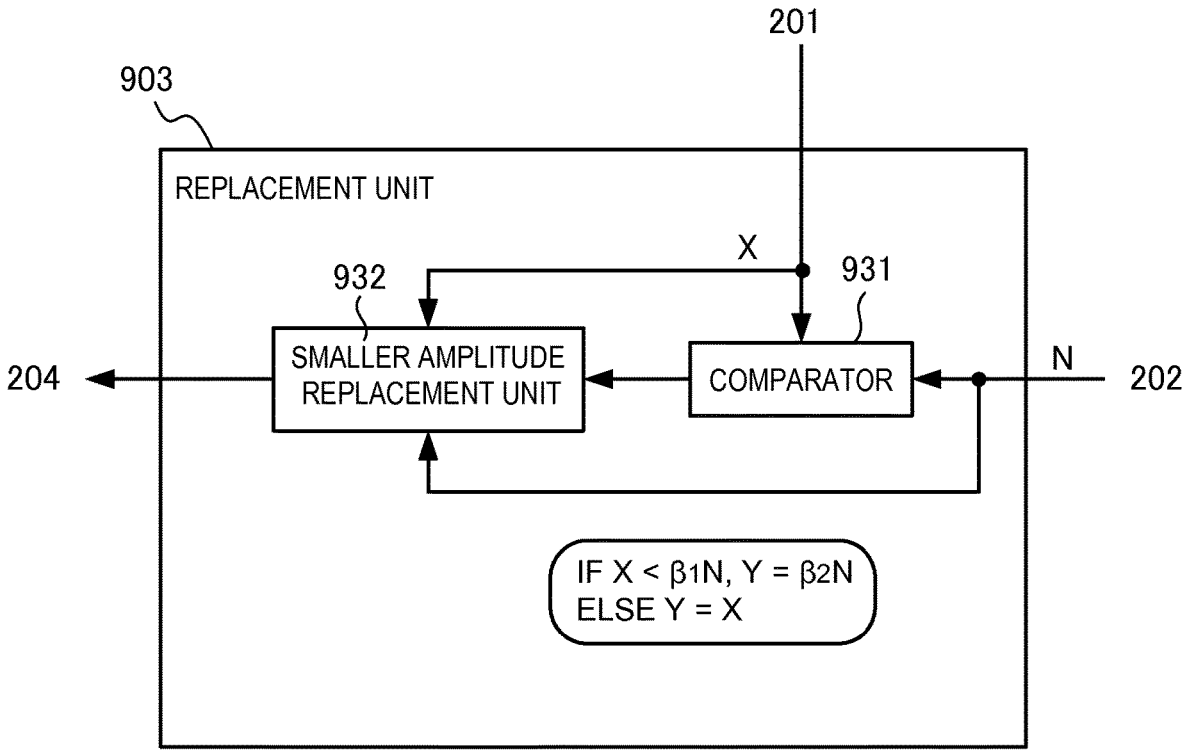
FIG. 9 is a block diagram showing the arrangement of a replacement unit according to the fourth embodiment of the present invention.

A signal processing apparatus according to the fourth embodiment of the present invention will be described with reference to FIGS. 9 to 11. FIG. 9 is a block diagram for explaining the arrangement of a replacement unit 903 of the signal processing apparatus according to this embodiment. The replacement unit 903 according to this embodiment is different from the second embodiment in that a comparator 931 and a lower amplitude replacement unit 932 are included. The rest of the components and operations is the same as in the second embodiment. Hence, the same reference numerals denote the same components and operations, and a detailed description thereof will be omitted.

The comparator 931 compares a noisy signal amplitude spectrum $|X(k, n)|$ with a multiple (second threshold), serving as the third function, of $\beta1(k, n)$ of a stationary component signal $N(k, n)$. If the amplitude (power) component $|X(k, n)|$ is smaller than the multiple of $\beta1(k, n)$ of the stationary component signal $N(k, n)$, the lower amplitude replacement unit 932 performs replacement by a multiple, serving as the fourth function, of $\beta2(k, n)$ of the stationary component signal $N(k, n)$; otherwise, the spectrum shape is directly used as an output signal $|Y(k, n)|$ of the replacement unit 903. That is, if $|X(k, n)|>\beta1(k, n)N(k, n)$, $|Y(k, n)|=\beta2(k, n)N(k, n)$ is obtained; otherwise, $|Y(k, n)|=|X(k, n)|$ is obtained.

Figure 10:
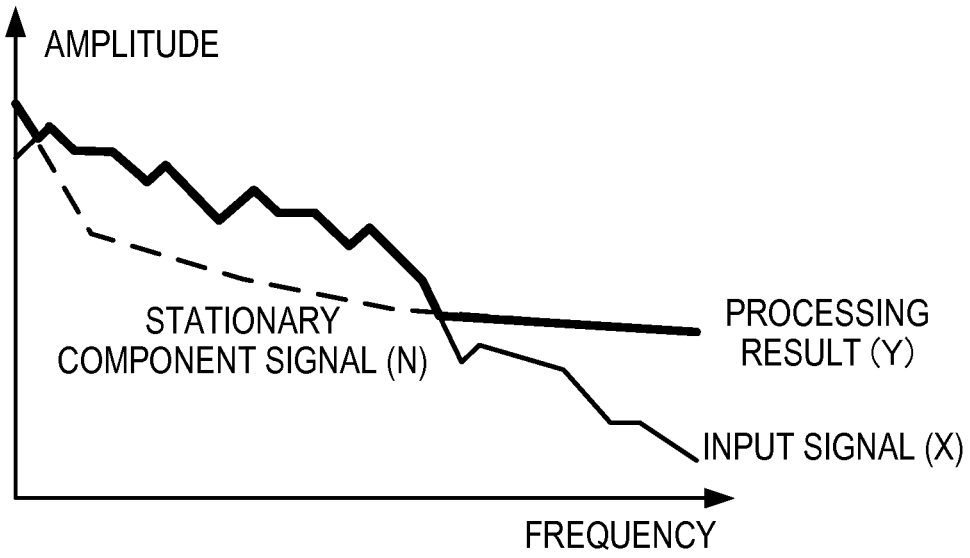
FIG. 10 is a graph showing a signal processing result by the replacement unit according to the fourth embodiment of the present invention.

FIG. 10 is a graph showing the relationship between the input signal $|X(k, n)|$, the stationary component $N(k, n)$, and the output signal $|Y(k, n)|$ when $\beta1(k, n)=\beta2(k, n)$.

This is effective when a variation in input signal is large in a frequency band in which power is smaller than the threshold $\beta1(k, n)N(k, n)$ obtained by multiplying the stationary component signal by the predetermined coefficient multiple. On the other hand, since it is possible to maintain the naturalness in a band in which power is smaller than the threshold $\beta1(k, n)N(k, n)$ obtained by multiplying the stationary component signal by the predetermined coefficient, the sound quality improves.

Figure 11:
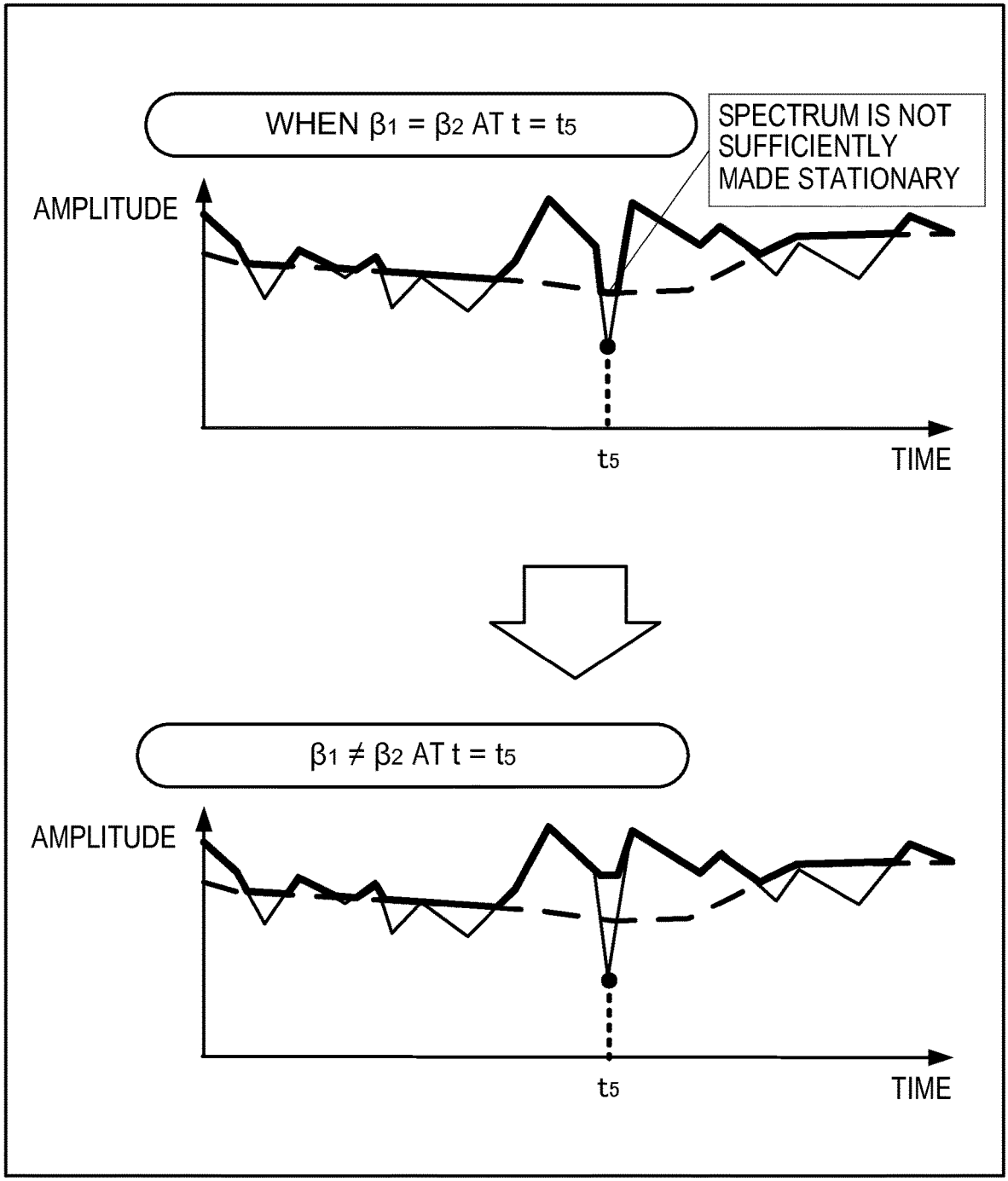
FIG. 11 is a view showing the signal processing result by the replacement unit according to the fourth embodiment of the present invention.

FIG. 11 is a view showing the relationship between the input signal $|X(k, n)|$, the stationary component signal $N(k, n)$, and the output signal $|Y(k, n)|$ when $\beta1(k, n)<\beta2(k, n)$ should hold. As for the input signal $|X(k, n)|$ shown in FIG. 11, if $\beta1(k, n)=\beta2(k, n)$, the spectrum is not sufficiently made stationary as shown in a graph in the upper portion, and thus it is impossible to sufficiently suppress noise with a strong non-stationary component like wind noise.

To cope with this, it is possible to replace the spectrum by a spectrum with higher stationarity by setting $\beta1(k, n)<\beta2(k, n)$ before and after time n=t5, as shown in the lower portion of FIG. 11.

At each time, $\beta(k, n)$ can be obtained according to a procedure of (1)→(2) below.

(1) A short-time moving average X_bar(k, n) (k and n are indices corresponding to the frequency and time, respectively) of the input signal is calculated in advance by, for example, $X_bar(k, n)=(X(k, n-2)+X(k, n-1)+X(k, n)+X(k, n+1)+X(k, n+2))/5$. (2) The difference between the short-time moving average ($X_bar(k, n)$) and a value ($\beta2(k, n)\cdot N(k, n)$) after replacement is calculated, and if the difference is large, the value of $\beta2(k, n)$ is changed to decrease the difference. If the changed value is represented by $\beta2_hat(k, n)$, the following methods may be used as a change method. (a) $\beta2_hat(k, n)=0.5\cdot\beta2(k, n)$ is uniformly set (constant multiplication is performed by a predetermined value). (b) $\beta2_hat(k, n)=(X_bar(k, n)/N(k, n)$ is set (calculation is performed using $X_bar(k, n)$ and $N(k, n)$). (c) $\beta2_hat(k, n)=0.8\cdot X_bar(k, n)/N(k, n)+0.2$ (same as above).

However, a method of obtaining $\beta2(k, n)$ is not limited to the above-described one. For example, $\beta2(k, n)$ which is a constant value regardless of the time may be set in advance.

In this case, the value of $\beta 2(k, n)$ may be determined by actually hearing a processed signal. That is, the value of $\beta 2(k, n)$ may be determined in accordance with the characteristics of a microphone and a device to which the microphone is attached.

For example, when the following condition is met, the coefficient $\beta 2(k, n)$ may be obtained by dividing the short-time moving average $|X_bar(k, n)|$ by the stationary component signal $N(k, n)$ before and after time n using equations 1 to 3, and the input signal $|X(k, n)|$ may be replaced by the short-time moving average $|X_bar(k, n)|$ as a result. When the following condition is not met, $\beta 2(k, n)=\beta 1(k, n)$ may be set.

$$|X(k,n)|>\beta 1(k,n)\cdot N(k,n) \text{ and } \beta 1(k,n)\cdot N(k,n)-|X_bar(k,n)|>\delta \quad \text{Condition:}$$

$$\beta 2(k,n-1)=X_bar(k,n)/N(k,n) \quad \text{Equation 1:}$$

$$\beta 2(k,n)=X_bar(k,n)/N(k,n) \quad \text{Equation 2:}$$

$$\beta 2(k,n+1)=X_bar(k,n)/N(k,n) \quad \text{Equation 3:}$$

As described above, in the stationary component signal $N(k, n)$, if it is impossible to prevent a "spike" of the amplitude component within a short time, it is possible to perform replacement using the short-time moving average, thereby improving the sound quality.

Fifth Embodiment

Figure 12:
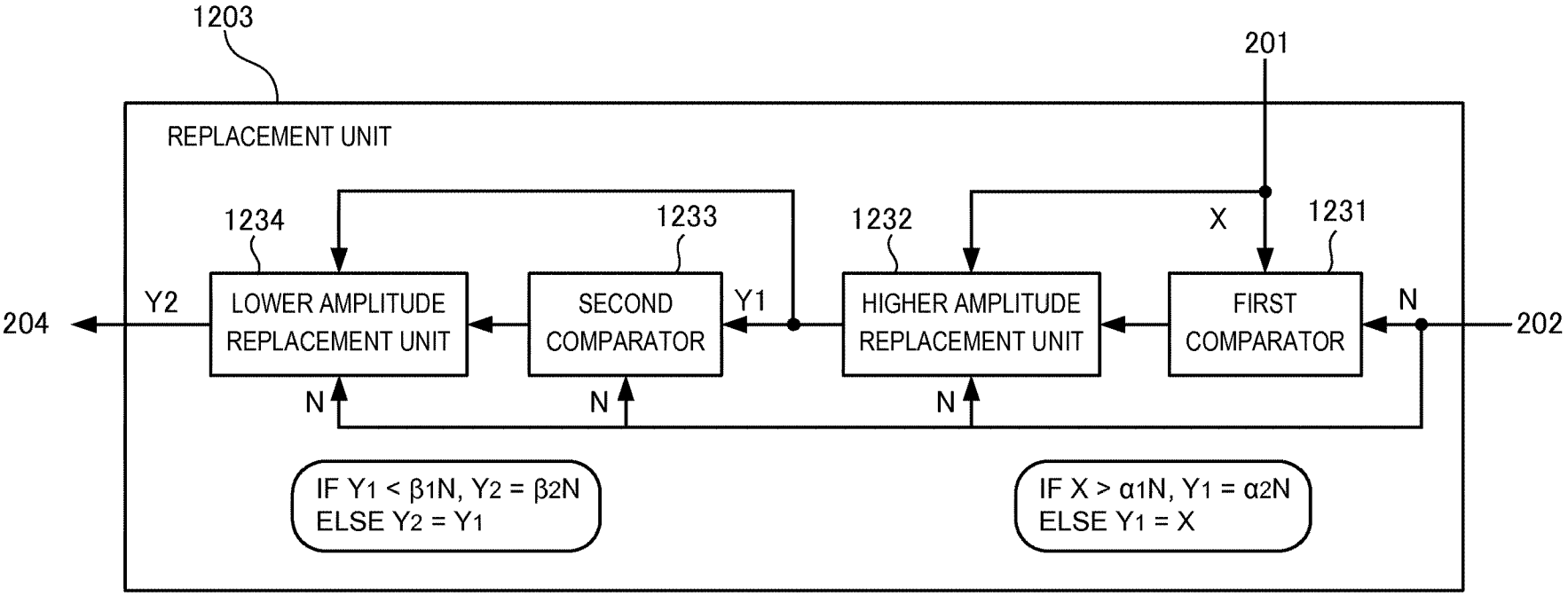
FIG. 12 is a block diagram showing the arrangement of a replacement unit according to the fifth embodiment of the present invention.

A signal processing apparatus according to the fifth embodiment of the present invention will be described with reference to FIGS. 12 and 13. FIG. 12 is a block diagram for explaining the arrangement of a replacement unit 1203 of the signal processing apparatus according to this embodiment. The replacement unit 1203 according to this embodiment is different from the second embodiment in that a first comparator 1231, a higher amplitude replacement unit 1232, a second comparator 1233, and a lower amplitude replacement unit 1234 are included. The rest of the components and operations is the same as in the second embodiment. Hence, the same reference numerals denote the same components and operations, and a detailed description thereof will be omitted.

The first comparator 1231 compares a noisy signal amplitude spectrum $|X(k, n)|$ with a multiple (third threshold), serving as the fifth function, of $\alpha 1(k, n)$ of a stationary component signal $N(k, n)$. If the amplitude (power) component $|X(k, n)|$ is larger than the multiple of $\alpha 1(k, n)$ of the stationary component signal $N(k, n)$, the higher amplitude replacement unit 1232 performs replacement by a multiple, serving as the sixth function, of $\alpha 2(k, n)$ of the stationary component signal $N(k, n)$; otherwise, the spectrum shape is directly used as an output signal $|Y1(k, n)|$ to the second comparator 1233. That is, if $|X(k, n)|>\alpha 1(k, n)N(k, n)$, $|Y1(k, n)|=\alpha 2(k, n)N(k, n)$ is obtained; otherwise, $|Y1(k, n)|=|X(k, n)|$ is obtained.

On the other hand, the second comparator 1233 compares the output signal $|Y1(k, n)|$ from the lower amplitude replacement unit 1234 with a multiple (fourth threshold), serving as the seventh function, of $\beta 1(k, n)$ of the stationary component signal $N(k, n)$. If the output signal $|Y1(k, n)|$ from the higher amplitude replacement unit 1232 is smaller than the multiple of $\beta 1(k, n)$ of the stationary component signal $N(k, n)$, the lower amplitude replacement unit 1234 performs replacement by a multiple, serving as the eighth function, of $\beta 2(k, n)$ of the stationary component signal $N(k, n)$; otherwise, the spectrum shape is directly used as an output signal $|Y2(k, n)|$. That is, if $|Y1(k, n)|<\beta 1(k, n)N(k, n)$, $|Y2(k, n)|=\beta 2(k, n)N(k, n)$ is obtained; otherwise, $|Y1(k, n)|=|Y2(k, n)|$ is obtained.

Figure 13:
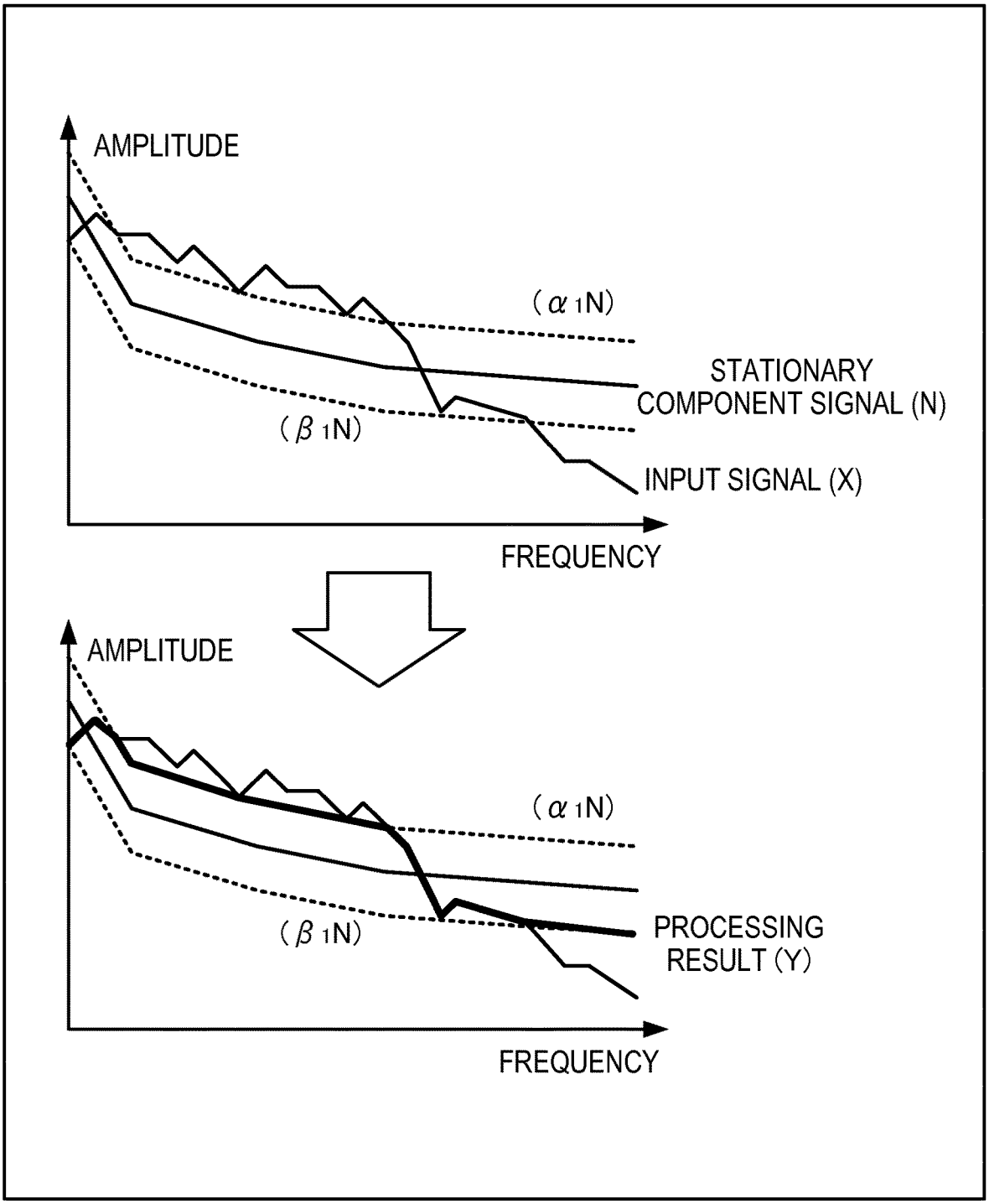
FIG. 13 is a view showing a signal processing result by the replacement unit according to the fifth embodiment of the present invention.

FIG. 13 is a view showing the relationship between the input signal $|X(k, n)|$, the stationary component signal $N(k, n)$, and the output signal $|Y(k, n)|$ when $\alpha 1(k, n)=\alpha 2(k, n)$ and $\beta 1(k, n)=\beta 2(k, n)$.

This is effective when a variation in input signal is large in a frequency band in which power is larger than the threshold $\alpha 1(k, n)N(k, n)$ obtained by multiplying the stationary component signal by the predetermined coefficient and a frequency band in which power is smaller than the threshold $\beta 1(k, n)N(k, n)$.

Sixth Embodiment

Figure 14:
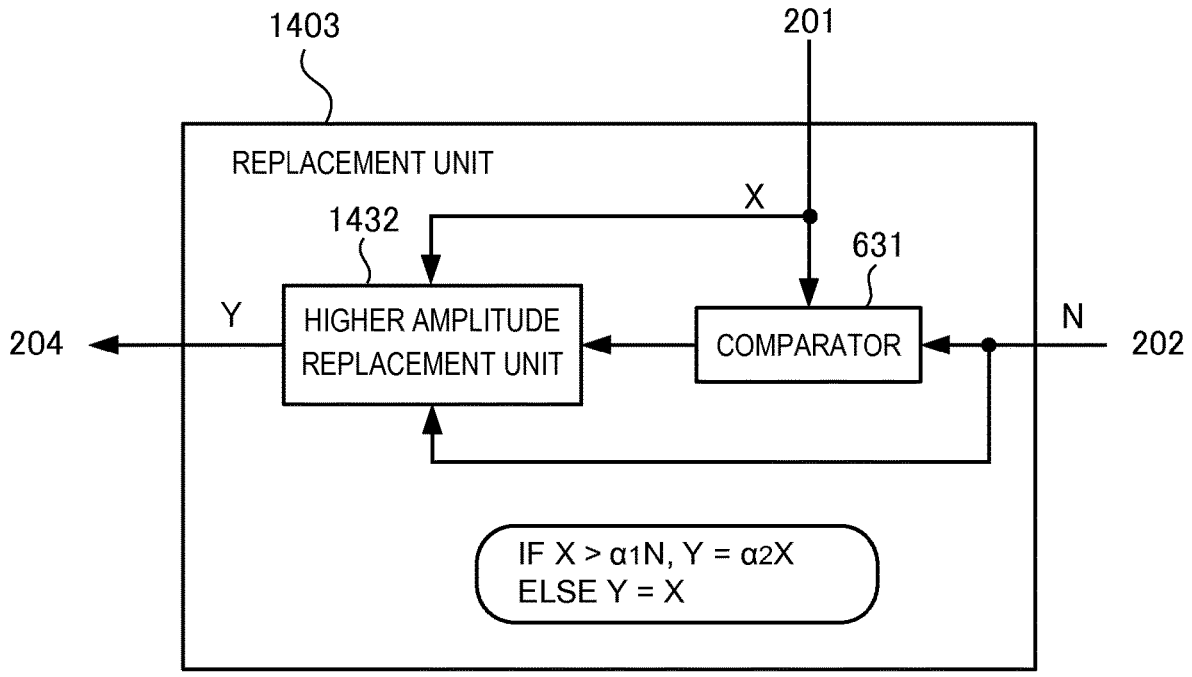
FIG. 14 is a block diagram showing the arrangement of a replacement unit according to the sixth embodiment of the present invention.

A signal processing apparatus according to the sixth embodiment of the present invention will be described with reference to FIGS. 14 and 15. FIG. 14 is a block diagram for explaining the arrangement of a replacement unit 1403 of the signal processing apparatus according to this embodiment. The replacement unit 1403 according to this embodiment is different from the third embodiment in that a higher amplitude replacement unit 1432 performs replacement using a multiple of a coefficient $\alpha(k, n)$ of a noisy signal amplitude spectrum $|X(k, n)|$. The rest of the components and operations is the same as in the third embodiment. Hence, the same reference numerals denote the same components and operations, and a detailed description thereof will be omitted.

If the amplitude (power) component $|X(k, n)|$ is larger than a multiple of $\alpha 1(k, n)$ of the stationary component signal $N(k, n)$, the higher amplitude replacement unit 1432 performs replacement by a multiple of $\alpha 2(k, n)$ of the amplitude component $X(k, n)$; otherwise, the spectrum shape is directly used as an output signal $|Y(k, n)|$ of the replacement unit 1403. That is, if $|X(k, n)|>\alpha 1(k, n)N(k, n)$, $|Y(k, n)|=\alpha 2(k, n)|X(k, n)|$ is obtained; otherwise, $|Y(k, n)|=|X(k, n)|$ is obtained.

Figure 15:
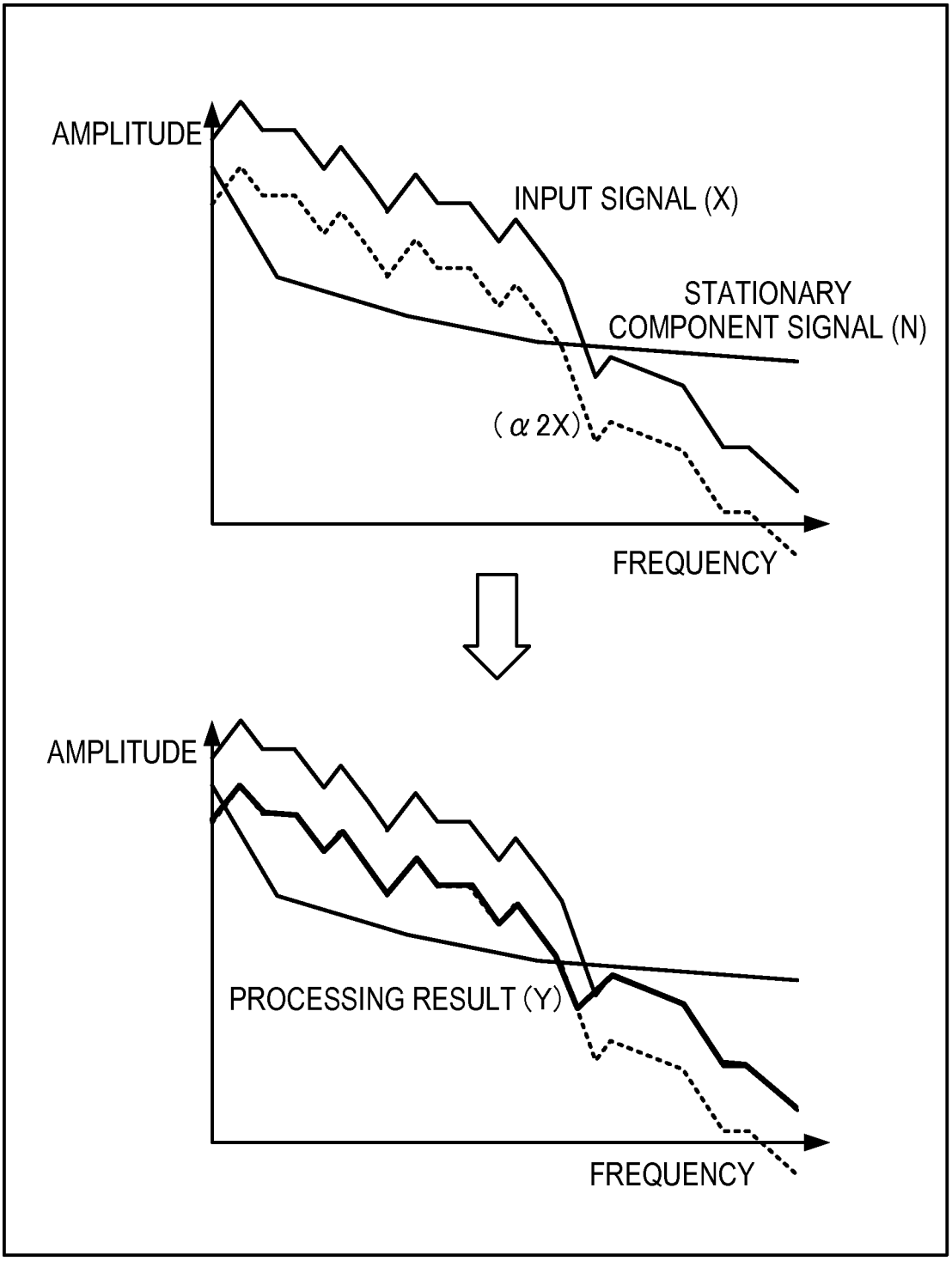
FIG. 15 is a view showing a signal processing result by the replacement unit according to the sixth embodiment of the present invention.

FIG. 15 is a view showing the relationship between the input signal $|X(k, n)|$, the stationary component signal $N(k, n)$, and the output signal $|Y(k, n)|$ when $\alpha 1(k, n)=1$ and $\alpha 2(k, n)=0.7$.

This is effective when a variation in input signal is large in a frequency band in which power is larger than the threshold $\alpha 1(k, n)N(k, n)$ obtained by multiplying the stationary component signal by the predetermined coefficient and when the characteristic of the spectrum shape preferably remains as much as possible in an output signal. For example, it is effective to perform the processing according to this embodiment in a speech section when it is desirable to perform speech recognition while suppressing wind noise. On the other hand, since it is possible to maintain the naturalness in a band in which power is smaller than the threshold $\alpha 1(k, n)N(k, n)$ obtained by multiplying the stationary component signal by the predetermined coefficient, the sound quality improves.

Seventh Embodiment

Figure 16:
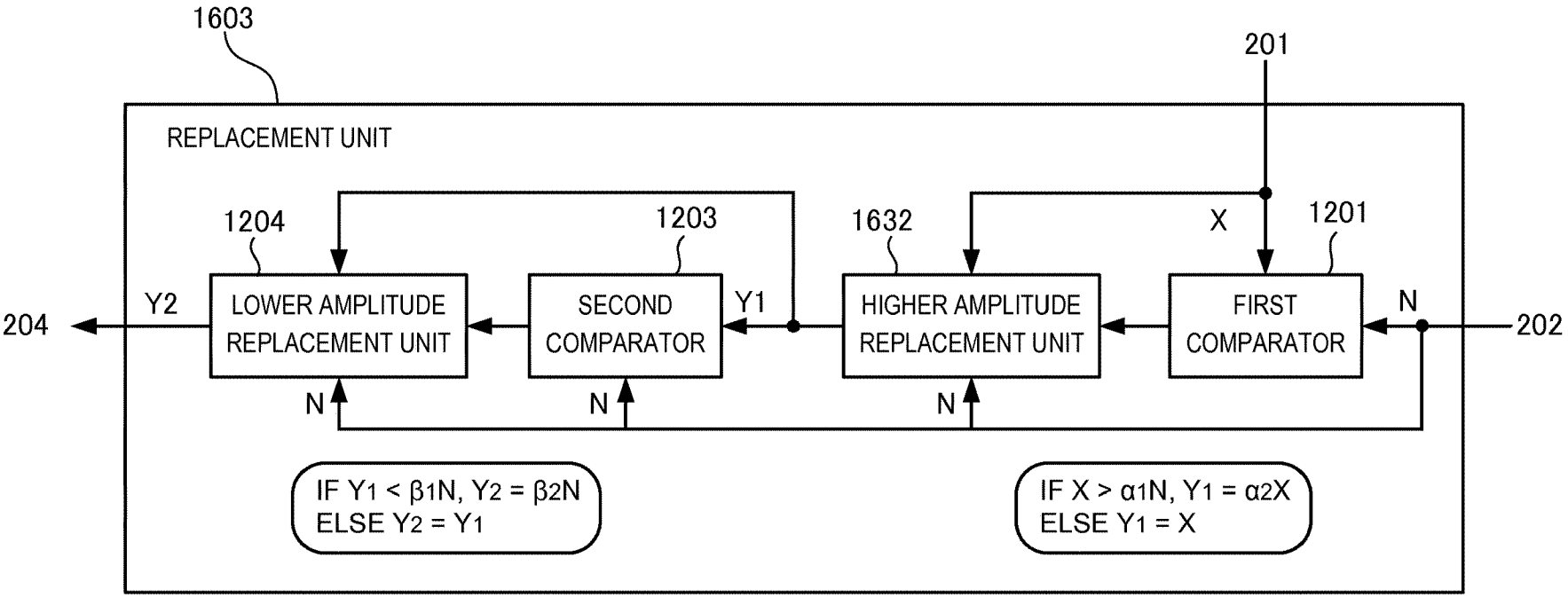
FIG. 16 is a block diagram showing the arrangement of a replacement unit according to the seventh embodiment of the present invention.

A signal processing apparatus according to the seventh embodiment of the present invention will be described with reference to FIG. 16. FIG. 16 is a block diagram for explaining the arrangement of a replacement unit 1603 of the signal processing apparatus according to this embodiment. The replacement unit 1603 according to this embodiment is different from the fifth embodiment in that a higher amplitude replacement unit 1632 performs replacement using a multiple of a coefficient $|\alpha(k, n)|$ of a noisy signal amplitude spectrum $|X(k, n)|$, similarly to the replacement unit 1403 according to the sixth embodiment. The rest of the components and operations is the same as in the fifth embodiment. Hence, the same reference numerals denote the same components and operations, and a detailed description thereof will be omitted.

This is effective when a variation in input signal is large in a frequency band in which power is larger than a threshold $\alpha 1(k, n)N(k, n)$ obtained by multiplying the stationary component signal by a predetermined coefficient and a frequency band in which power is smaller than a threshold $\beta 1(k, n)N(k, n)$ and when the characteristic of the spectrum shape preferably remains as much as possible in an output signal.

Eighth Embodiment

Figure 17:
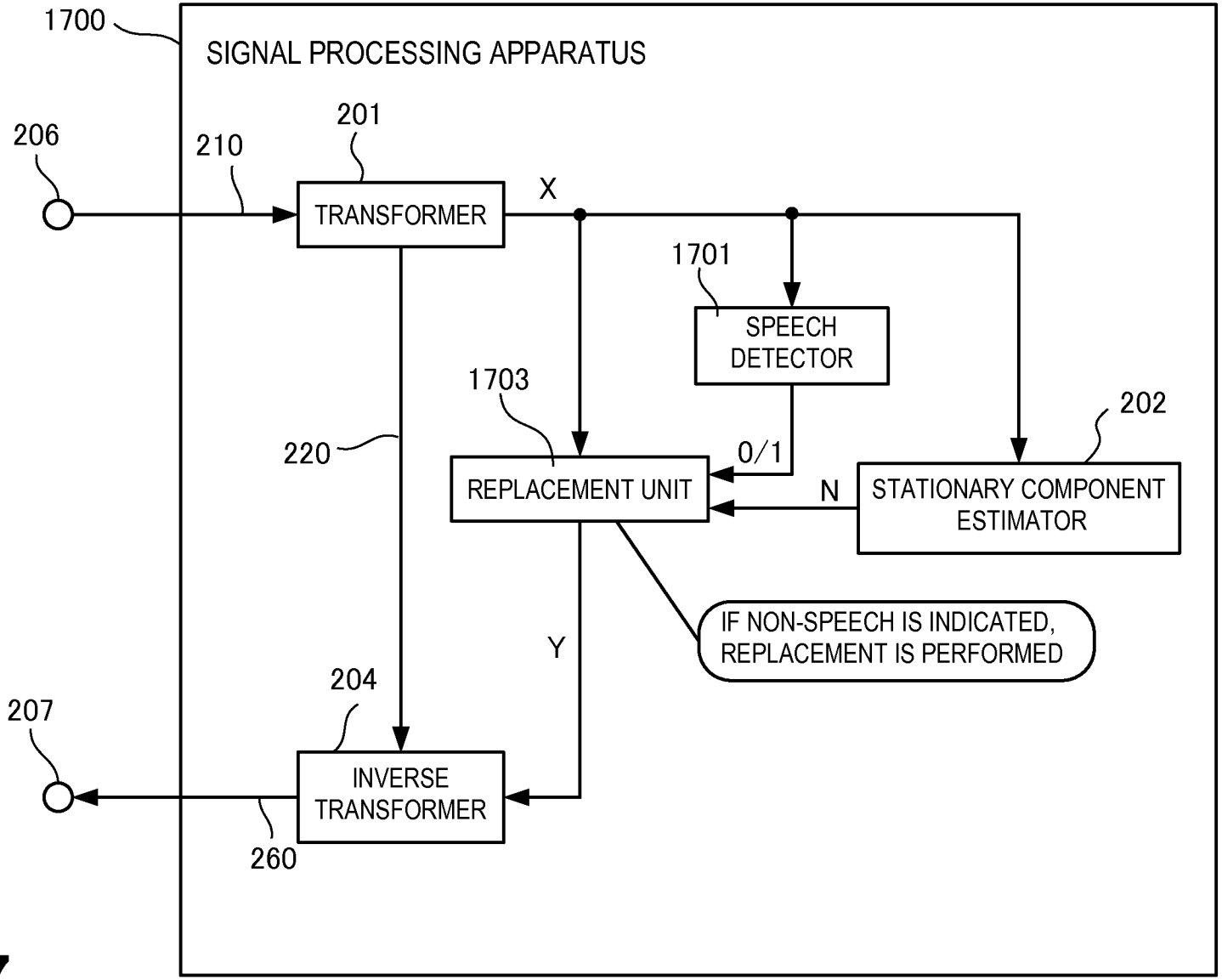
FIG. 17 is a block diagram showing the arrangement of a signal processing apparatus according to the eighth embodiment of the present invention.

A signal processing apparatus according to the eighth embodiment of the present invention will be described with reference to FIG. 17. FIG. 17 is a block diagram for explaining the arrangement of a signal processing apparatus 1700 according to this embodiment. The signal processing apparatus 1700 according to this embodiment is different from the second embodiment in that a speech detector 1701 is included and a replacement unit 1703 performs replacement processing in accordance with a speech detection result. The rest of the components and operations is the same as in the second embodiment. Hence, the same reference numerals denote the same components and operations, and a detailed description thereof will be omitted.

The speech detector 1701 determines, on a frequency basis, whether speech is included in a noisy signal amplitude spectrum $|X(k, n)|$. The replacement unit 1703 replaces the noisy signal amplitude spectrum $|X(k, n)|$ at a frequency at which no speech is included by using a stationary component spectrum $N(k, n)$. That is, if the output of the speech detector 1701 is 1 or it is determined that speech is included, $|Y(k, n)|=\alpha(k, n)N(k, n)$ is obtained. If the output of the speech detector 1701 is 0 or it is determined that no speech is included, $|Y(k, n)|=|X(k, n)|$ is obtained.

According to this embodiment, since replacement is performed using the stationary component signal $N(k, n)$ at a frequency except for that at which speech is included, it is possible to avoid a distortion of speech caused by suppression.

Ninth Embodiment

Figure 18:
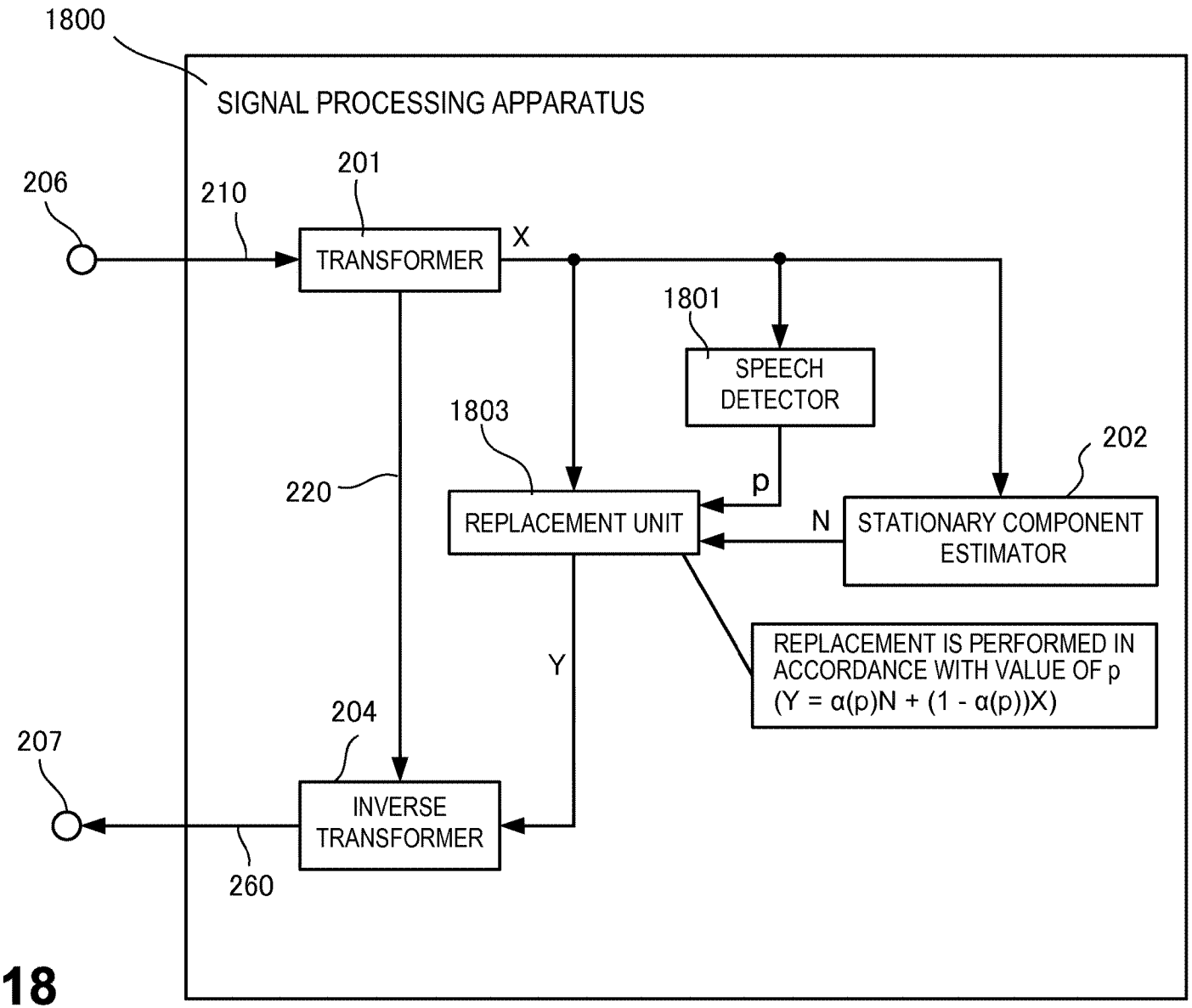
FIG. 18 is a block diagram showing the arrangement of a signal processing apparatus according to the ninth embodiment of the present invention.

A signal processing apparatus according to the ninth embodiment of the present invention will be described with reference to FIGS. 18 to 21. FIG. 18 is a block diagram for explaining the arrangement of a signal processing apparatus 1800 according to this embodiment. The signal processing apparatus 1800 according to this embodiment is different from the second embodiment in that a speech detector 1801 is included and a replacement unit 1803 performs replacement processing in accordance with a speech detection result. The rest of the components and operations is the same as in the second embodiment. Hence, the same reference numerals denote the same components and operations, and a detailed description thereof will be omitted.

The speech detector 1801 calculates a probability $p(k, n)$ that speech is included in a noisy signal amplitude spectrum $|X(k, n)|$ on a frequency basis where $p(k, n)$ is a real number of 0 (inclusive) to 1 (inclusive). The replacement unit 1803 replaces the noisy signal amplitude spectrum $|X(k, n)|$ using the speech presence probability $p(k, n)$ and a stationary component signal $N(k, n)$. By using, for example, a function $\alpha(p(k, n))$ of $p(k, n)$ ranging from 0 to 1, an output signal $|Y(k, n)|=\alpha(p(k, n))N(k, n)+(1-\alpha(p(k, n)))|X(k, n)|$ may be obtained.

Figure 19:
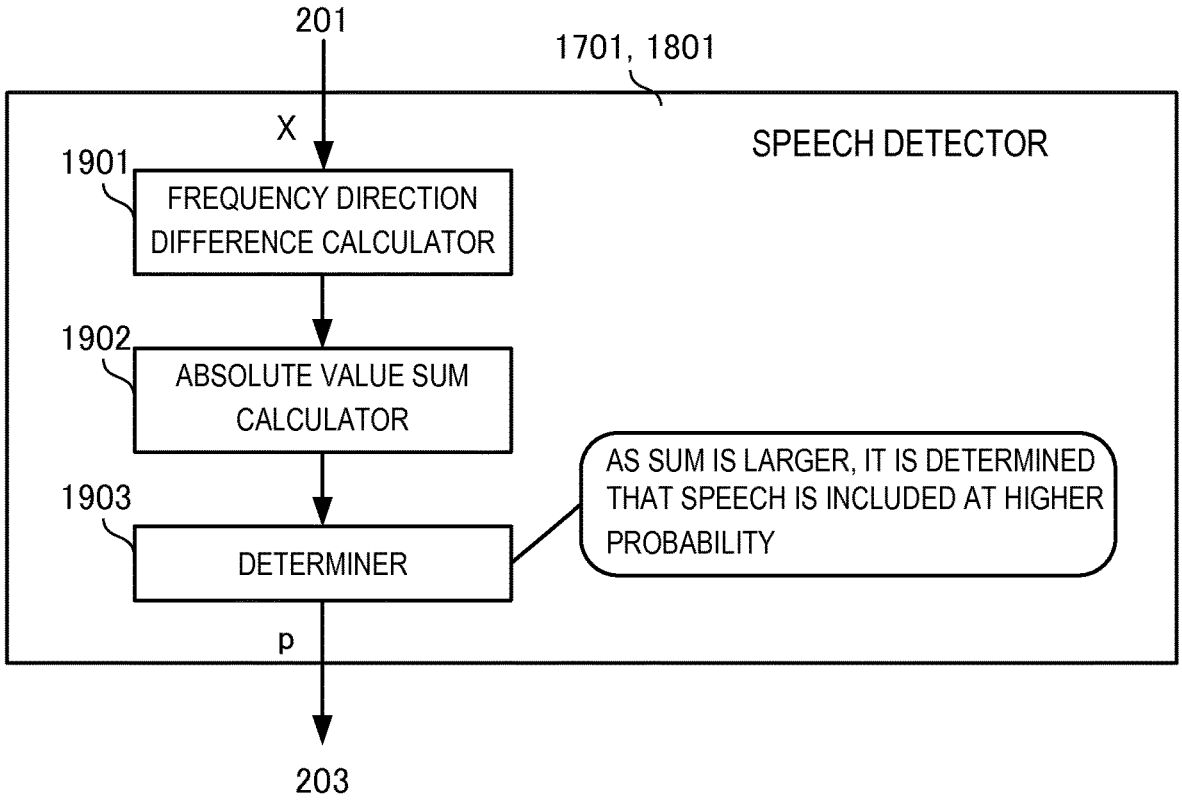
FIG. 19 is a block diagram showing an example of the arrangement of a speech detector according to the ninth embodiment of the present invention.

FIG. 19 is a block diagram showing an example of the internal arrangement of a speech detector 1701. A frequency direction difference calculator 1901 calculates the difference between amplitude components at adjacent frequencies. An absolute value sum calculator 1902 calculates the sum of absolute differences between the amplitude components calculated by the frequency direction difference calculator 1901. A determiner 1903 derives the speech presence probability $p(k, n)$ based on the sum of absolute values calculated by the absolute value sum calculator 1902. More specifically, as the sum of absolute values is larger, it is determined that speech is included at higher probability.

Figure 20:
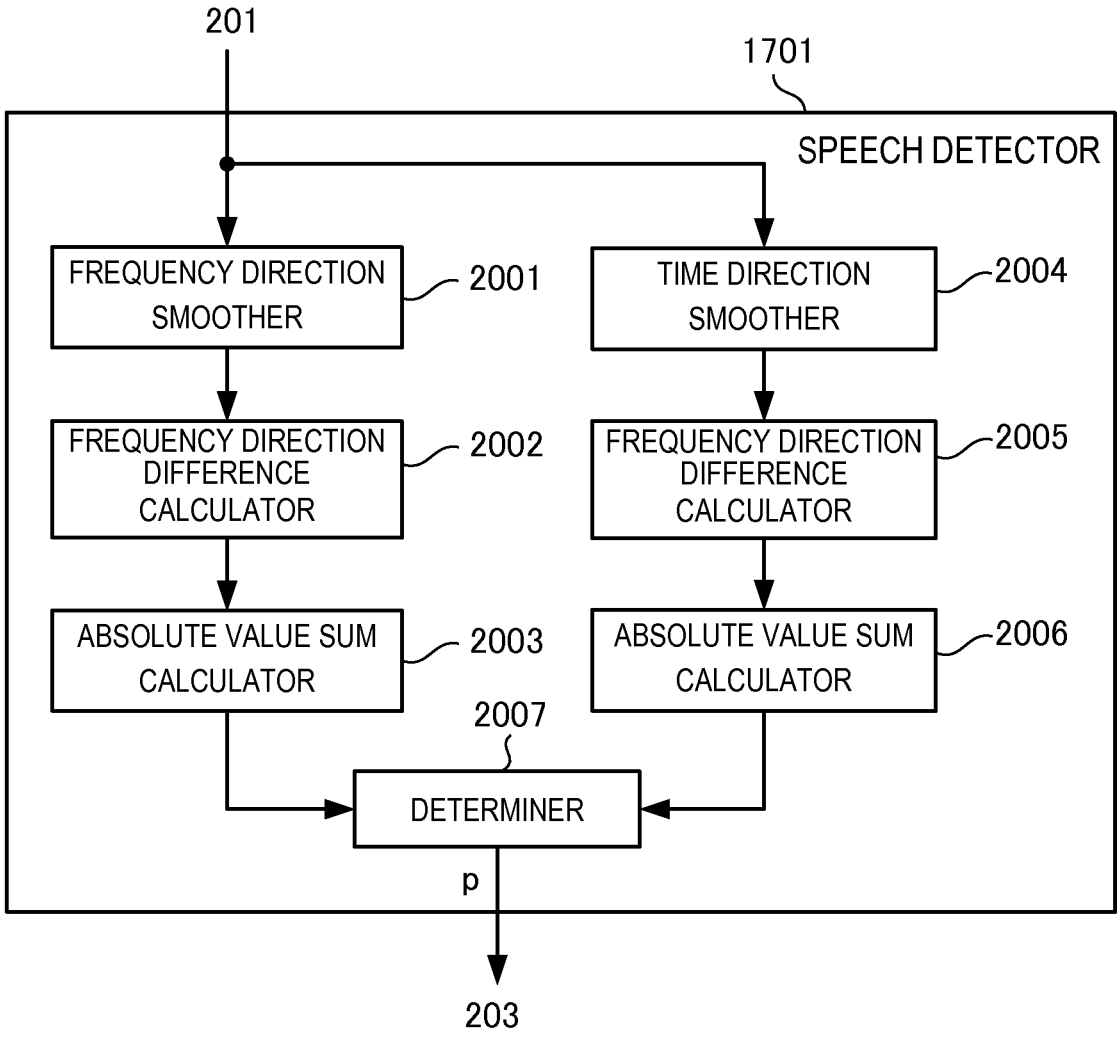
FIG. 20 is a block diagram showing another example of the arrangement of the speech detector according to the ninth embodiment of the present invention.

FIG. 20 is a block diagram showing another example of the internal arrangement of the speech detector 1701. A frequency direction smoother 2001 smoothes an input amplitude component in the frequency direction. A frequency direction difference calculator 2002 calculates the difference between amplitude components at adjacent frequencies. An absolute value sum calculator 2003 calculates the sum of absolute differences between amplitude components calculated by the frequency direction difference calculator 2002.

On the other hand, a time direction smoother 2004 smoothes the input amplitude component in the time direction. A frequency direction difference calculator 2005 calculates the difference between amplitude components at adjacent frequencies. An absolute value sum calculator 2006 calculates the sum of absolute differences between amplitude components calculated by the frequency direction difference calculator 2005.

A determiner 2007 derives the speech presence probability $p(k, n)$ based on the sums of absolute values calculated by the absolute value sum calculators 2003 and 2006.

In each of FIGS. 19 and 20, the processing is terminated by obtaining the speech presence probability $p(k, n)$. However, the presence/absence (0/1) of speech signal may be obtained by comparing the speech presence probability $p(k, n)$ with a predetermined threshold q. Note that the methods shown in FIGS. 19 and 20 have been described as examples of a speech detection method but the present invention is not limited to them. For example, the speech detection methods described in non-patent literatures 4 to 7 may be applied in this embodiment.

Figure 21:
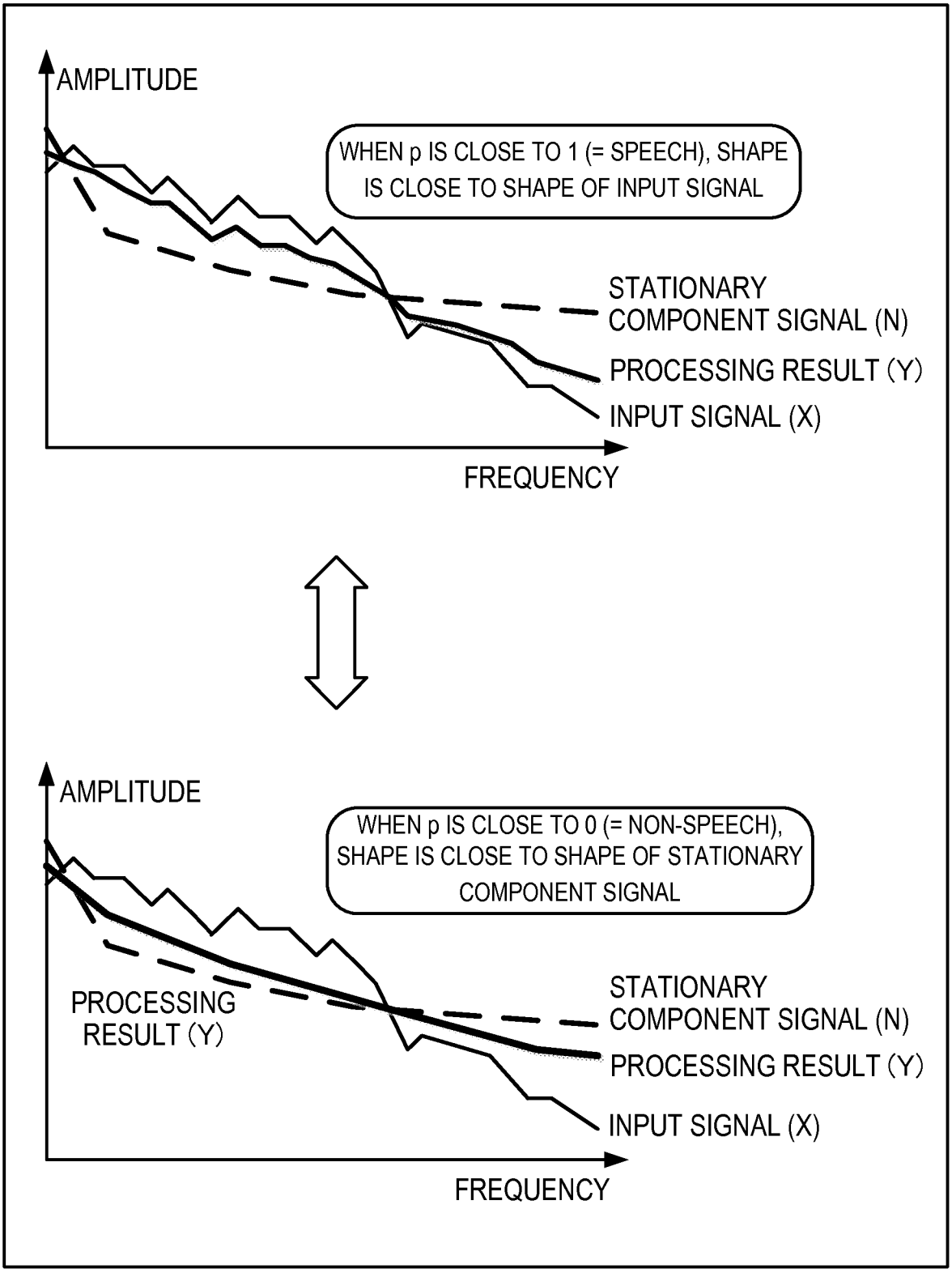
FIG. 21 is a view showing a signal processing result by the signal processing apparatus according to the ninth embodiment of the present invention.

FIG. 21 is a view showing a change in spectrum shape of the output signal $|Y(k, n)|$ in accordance with the value of $p(k, n)$. A graph in the upper portion of FIG. 21 shows a case in which $p(k, n)$ is close to 1 (=speech) for all the values of k, and the processing result $|Y(k, n)|$ has a spectrum shape closer to that of the input signal $|X(k, n)|$. On the other hand, a graph in the lower portion of FIG. 21 shows a case in which $p(k, n)$ is close to 0 (=non-speech) for all the values of k, and the processing result $|Y(k, n)|$ has a spectrum shape closer to that of the stationary component signal $N(k, n)$.

According to this embodiment, it is possible to make noise stationary in accordance with the speech presence probability, and suppress non-stationary noise like wind noise while effectively avoiding a distortion of speech and the like.

10th Embodiment

Figure 22:
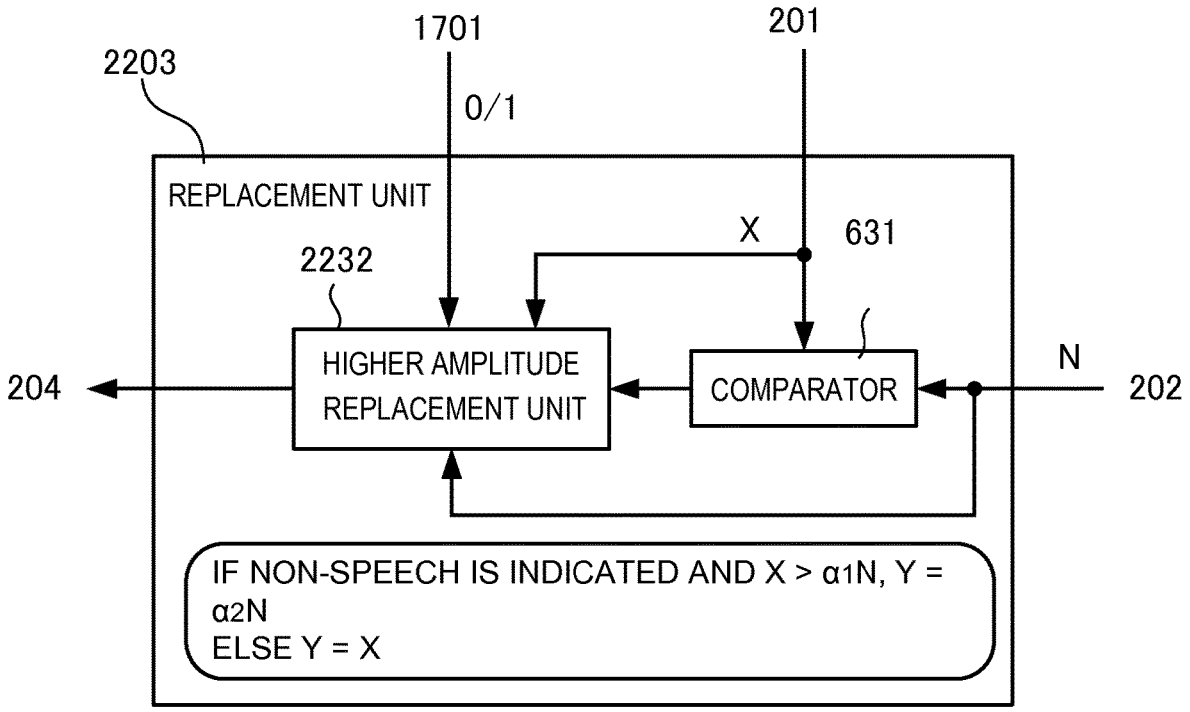
FIG. 22 is a block diagram showing the arrangement of a replacement unit according to the 10th embodiment of the present invention.

A signal processing apparatus according to the 10th embodiment of the present invention will be described with reference to FIG. 22. FIG. 22 is a block diagram for explaining the arrangement of a replacement unit 2203 according to this embodiment. The replacement unit 2203 according to this embodiment is different from the eighth embodiment in that a comparator 631 and a higher amplitude replacement unit 2232 are included. The comparator 631 is the same as that described with reference to FIG. 6, and the rest of the components and operations is the same as in the eighth embodiment. Hence, the same reference numerals denote the same components and operations, and a detailed description thereof will be omitted.

The higher amplitude replacement unit 2232 receives a speech detection flag (0/1) from a speech detector 1701. If the flag indicates non-speech and $|X(k, n)|>\alpha1(k, n)N(k, n)$, $|Y(k, n)|=\alpha2(k, n)N(k, n)$ is obtained; otherwise, $|Y(k, n)|=|X(k, n)|$ is obtained.

This is effective when a variation in input signal is large in a frequency band in which power is larger than the threshold $\alpha1(k, n)N(k, n)$ obtained by multiplying a stationary component signal by a predetermined coefficient in a non-speech band. On the other hand, since it is possible to maintain the naturalness in a speech band or a band in which power is smaller than the threshold $\alpha1(k, n)N(k, n)$ obtained by multiplying the stationary component signal by the predetermined coefficient, the sound quality improves.

11th Embodiment

Figure 23:
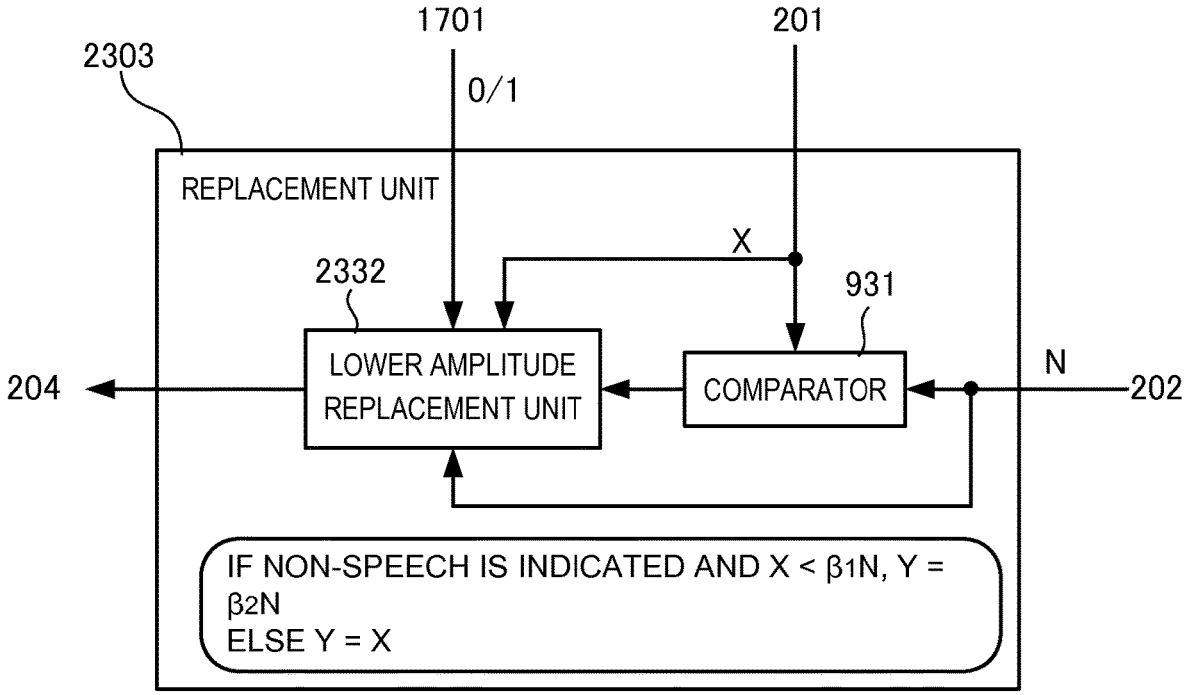
FIG. 23 is a block diagram showing the arrangement of a replacement unit according to the 11th embodiment of the present invention.

A signal processing apparatus according to the 11th embodiment of the present invention will be described with reference to FIG. 23. FIG. 23 is a block diagram for explaining the arrangement of a replacement unit 2303 of the signal processing apparatus according to this embodiment. The replacement unit 2303 according to this embodiment is different from the eighth embodiment in that a comparator 931 and a lower amplitude replacement unit 2332 are included. The comparator 931 is the same as that described with reference to FIG. 9, and the rest of the components and operations is the same as in the eighth embodiment. Hence, the same reference numerals denote the same components and operations, and a detailed description thereof will be omitted.

The lower amplitude replacement unit 2332 receives a speech detection flag (0/1) from a speech detector 1701. If the flag indicates non-speech and $|X(k, n)|<\beta1(k, n)N(k, n)$, $|Y(k, n)|=\beta2(k, n)N(k, n)$ is obtained; otherwise, $|Y(k, n)|=|X(k, n)|$ is obtained.

This is effective when a variation in input signal is large in a frequency band in which power is smaller than the threshold $\beta1(k, n)N(k, n)$ obtained by multiplying a stationary component signal by a predetermined coefficient in a non-speech band. On the other hand, since it is possible to maintain the naturalness in a speech band or a band in which power is larger than the threshold $\beta1(k, n)N(k, n)$ obtained by multiplying the stationary component signal by the predetermined coefficient, the sound quality improves.

12th Embodiment

Figure 24:
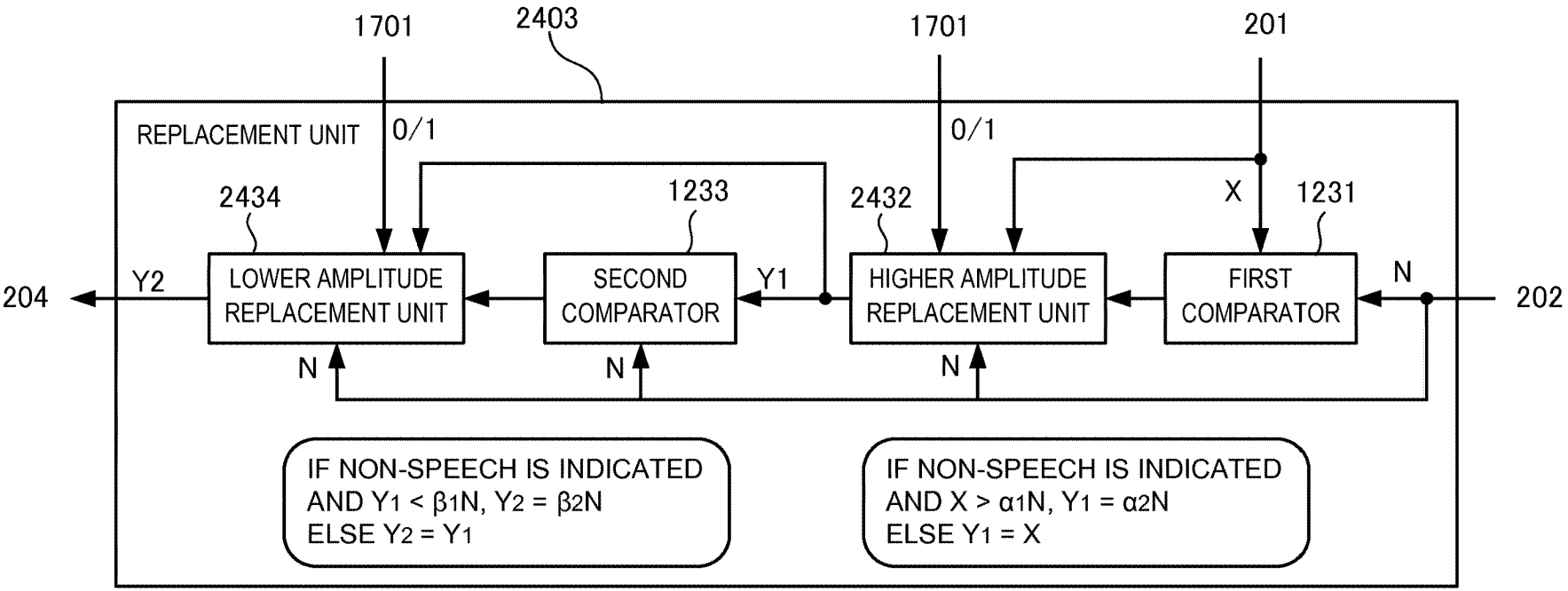
FIG. 24 is a block diagram showing the arrangement of a replacement unit according to the 12th embodiment of the present invention.

A signal processing apparatus according to the 12th embodiment of the present invention will be described with reference to FIG. 24. FIG. 24 is a block diagram for explaining the arrangement of a replacement unit 2403 of the signal processing apparatus according to this embodiment. The replacement unit 2403 according to this embodiment is different from the eighth embodiment in that a first comparator 1231, a higher amplitude replacement unit 2432, a second comparator 1233, and a lower amplitude replacement unit 2434 are included. The first comparator 1231 and the second comparator 1233 are the same as those described with reference to FIG. 12, and the rest of the components and operations is the same as in the eighth embodiment. Hence, the same reference numerals denote the same components and operations, and a detailed description thereof will be omitted.

The higher amplitude replacement unit 2432 receives a speech detection flag (0/1) from a speech detector 1701. If the flag indicates non-speech and $|X(k, n)|>\alpha1(k, n)N(k, n)$, $|Y1(k, n)|=\alpha2(k, n)N(k, n)$ is obtained; otherwise, $|Y1(k, n)|=|X(k, n)|$ is obtained. That is, if the amplitude (power) component $|X(k, n)|$ is larger than a multiple of $\alpha1(k, n)$ of the stationary component signal $|N(k, n)|$ in a non-speech section, the higher amplitude replacement unit 2432 performs replacement by a multiple of $\alpha2(k, n)$ of the stationary component signal $|N(k, n)|$; otherwise, the spectrum shape is directly used as an output signal $|Y1(k, n)|$ to the second comparator 1233.

On the other hand, the lower amplitude replacement unit 2434 replaces, by a multiple of $\beta2(k, n)$ of the stationary component signal $N(k, n)$, the output signal only at a frequency at which the output signal $|Y1(k, n)|$ from the higher amplitude replacement unit 2432 is smaller than the multiple of $\beta2(k, n)$ of the stationary component signal $N(k, n)$ in a non-speech section. At a frequency at which the output signal $|Y1(k, n)|$ is larger than the multiple of $\beta2(k, n)$, the spectrum shape is directly used as an output signal $|Y2(k, n)|$. That is, if $|Y1(k, n)|<\beta1(k, n)N(k, n)$, $|Y2(k, n)|=\beta2(k, n)N(k, n)$ is obtained; otherwise, $|Y1(k, n)|=|Y2(k, n)|$ is obtained.

This is effective when a variation in input signal is large in a frequency band in which power is larger than the threshold $\alpha1(k, n)N(k, n)$ obtained by multiplying the stationary component signal by the predetermined coefficient and a frequency band in which power is smaller than the threshold $\beta1(k, n)N(k, n)$ and when the characteristic of the spectrum shape preferably remains as much as possible in a speech section.

13th Embodiment

Figure 25:
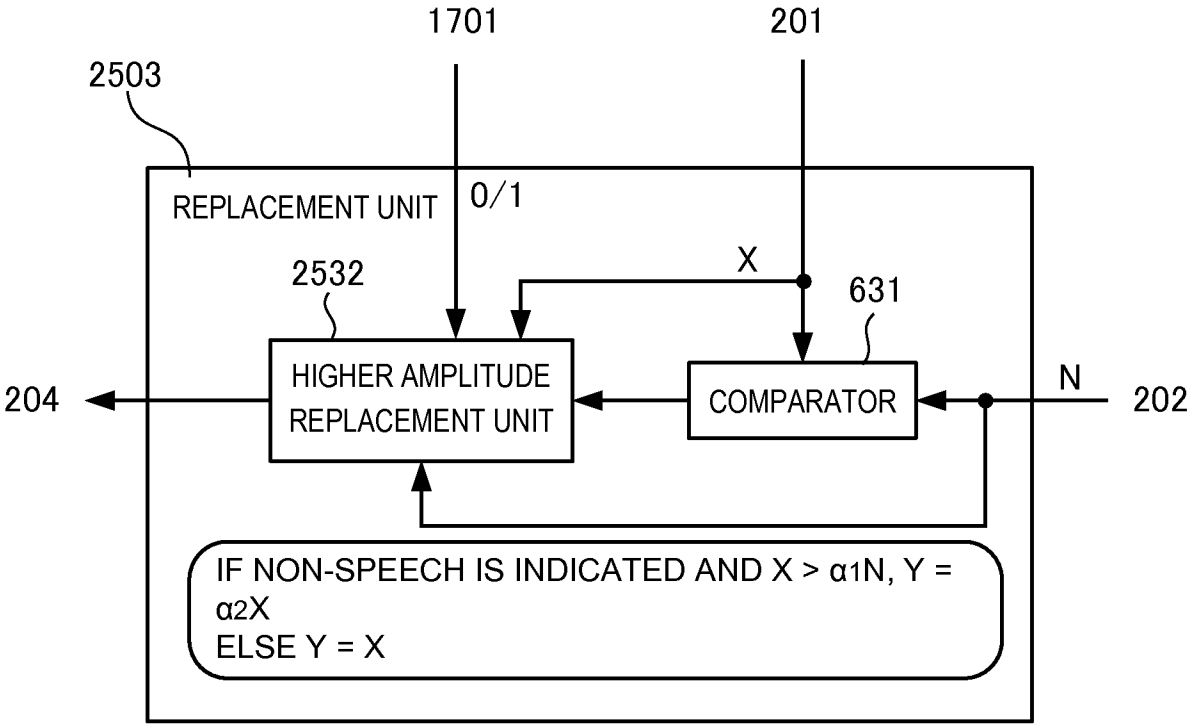
FIG. 25 is a block diagram showing the arrangement of a replacement unit according to the 13th embodiment of the present invention.

A signal processing apparatus according to the 13th embodiment of the present invention will be described with reference to FIG. 25. FIG. 25 is a block diagram for explaining the arrangement of a replacement unit 2503 of the signal processing apparatus according to this embodiment. The replacement unit 2503 according to this embodiment is different from the 10th embodiment in that a higher amplitude replacement unit 2532 performs replacement using a multiple of a coefficient $\alpha2(k, n)$ of a noisy signal amplitude spectrum $|X(k, n)|$, similarly to the sixth embodiment. The rest of the components and operations is the same as in the 10th embodiment. Hence, the same reference numerals denote the same components and operations, and a detailed description thereof will be omitted.

If the amplitude (power) component $|X(k, n)|$ is larger than a multiple of $\alpha1(k, n)$ of the stationary component signal $N(k, n)$ in a non-speech section, the higher amplitude replacement unit 2532 performs replacement by a multiple of $\alpha2(k, n)$ of the input amplitude component $|X(k, n)|$; otherwise, the spectrum shape is directly used as an output signal $|Y1(k, n)|$ of the replacement unit 2503. That is, if $|X(k, n)|>\alpha1(k, n)N(k, n)$, $|Y(k, n)|=\alpha2(k, n)|X(k, n)|$ is obtained; otherwise, $|Y(k, n)|=|X(k, n)|$ is obtained.

This is effective when a variation in input signal is large in a frequency band in which power is larger than the threshold $\alpha 1(k, n)N(k, n)$ obtained by multiplying the stationary component signal by the predetermined coefficient and when the characteristic of the spectrum shape preferably remains as much as possible in an output signal. For example, when it is desirable to recognize speech in a speech section while suppressing wind noise in a non-speech section, even if a non-speech section is determined, the spectrum shape in a section where power is large remains. Therefore, even if speech presence/absence determination is wrong, it is possible to improve the speech recognition accuracy.

14th Embodiment

Figure 26:
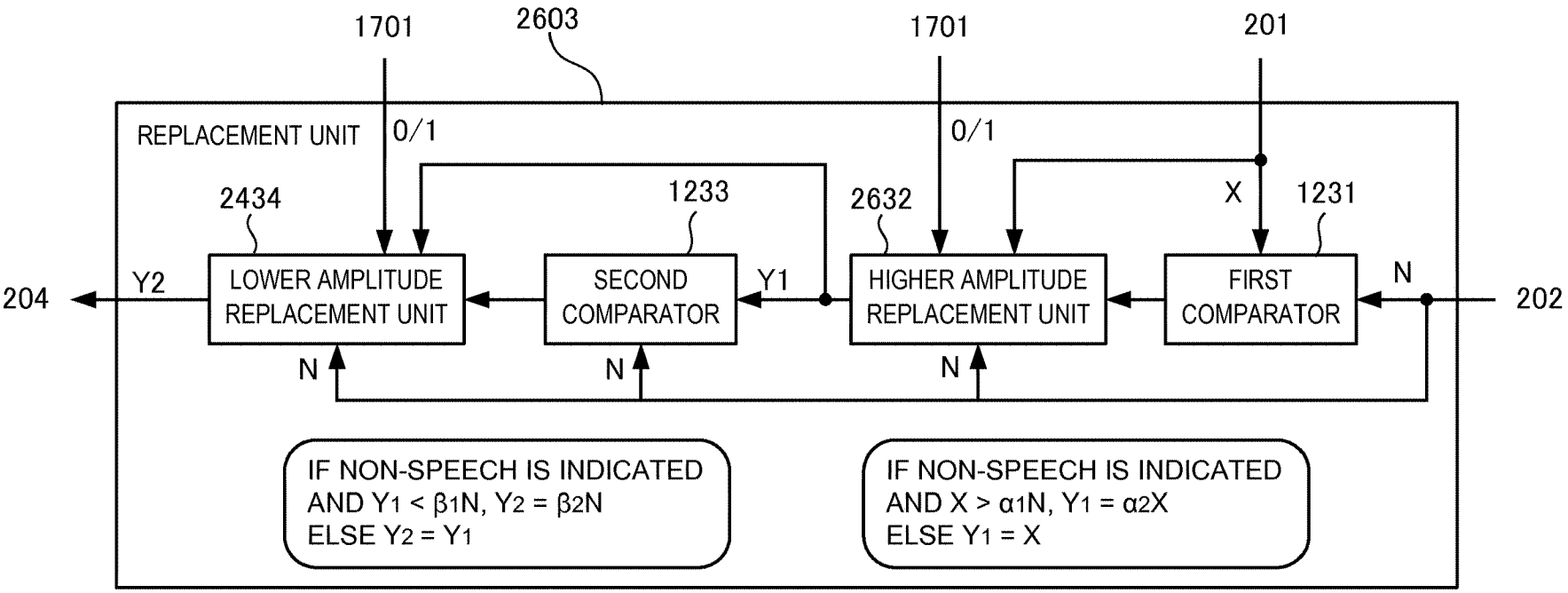
FIG. 26 is a block diagram showing the arrangement of a replacement unit according to the 14th embodiment of the present invention.

A signal processing apparatus according to the 14th embodiment of the present invention will be described with reference to FIG. 26. FIG. 26 is a block diagram for explaining the arrangement of a replacement unit 2603 of the signal processing apparatus according to this embodiment. The replacement unit 2603 according to this embodiment is different from the 12th embodiment in that a higher amplitude replacement unit 2632 performs replacement using a multiple of a coefficient $\alpha 2(k, n)$ of a noisy signal amplitude spectrum $|X(k, n)|$, similarly to the seventh embodiment. The rest of the components and operations is the same as in the 12th embodiment. Hence, the same reference numerals denote the same components and operations, and a detailed description thereof will be omitted.

If the amplitude (power) component $|X(k, n)|$ is larger than a multiple of $\alpha 1(k, n)$ of a stationary component signal $|N(k, n)|$ in a non-speech section, the higher amplitude replacement unit 2632 performs replacement by the multiple of $\alpha 2(k, n)$ of the input amplitude component $|X(k, n)|$; otherwise, the spectrum shape is directly used as an output signal $|Y1(k, n)|$ to the second comparator 1233. That is, if $|X(k, n)|>\alpha 1(k, n)N(k, n)$, $|Y1(k, n)|=\alpha 2(k, n)|X(k, n)|$ is obtained; otherwise, $|Y1(k, n)|=|X(k, n)|$ is obtained.

This is effective when a variation in input signal is large in a frequency band in which power is larger than the threshold $\alpha 1(k, n)N(k, n)$ obtained by multiplying the stationary component signal by the predetermined coefficient and when the characteristic of the spectrum shape preferably remains as much as possible in an output signal $|Y2(k, n)|$. For example, when it is desirable to recognize speech in a speech section while suppressing wind noise in a non-speech section, even if a non-speech section is determined, the spectrum shape in a section where power is large remains. Therefore, even if speech presence/absence determination is wrong, it is possible to improve the speech recognition accuracy.

15th Embodiment

Figure 27:
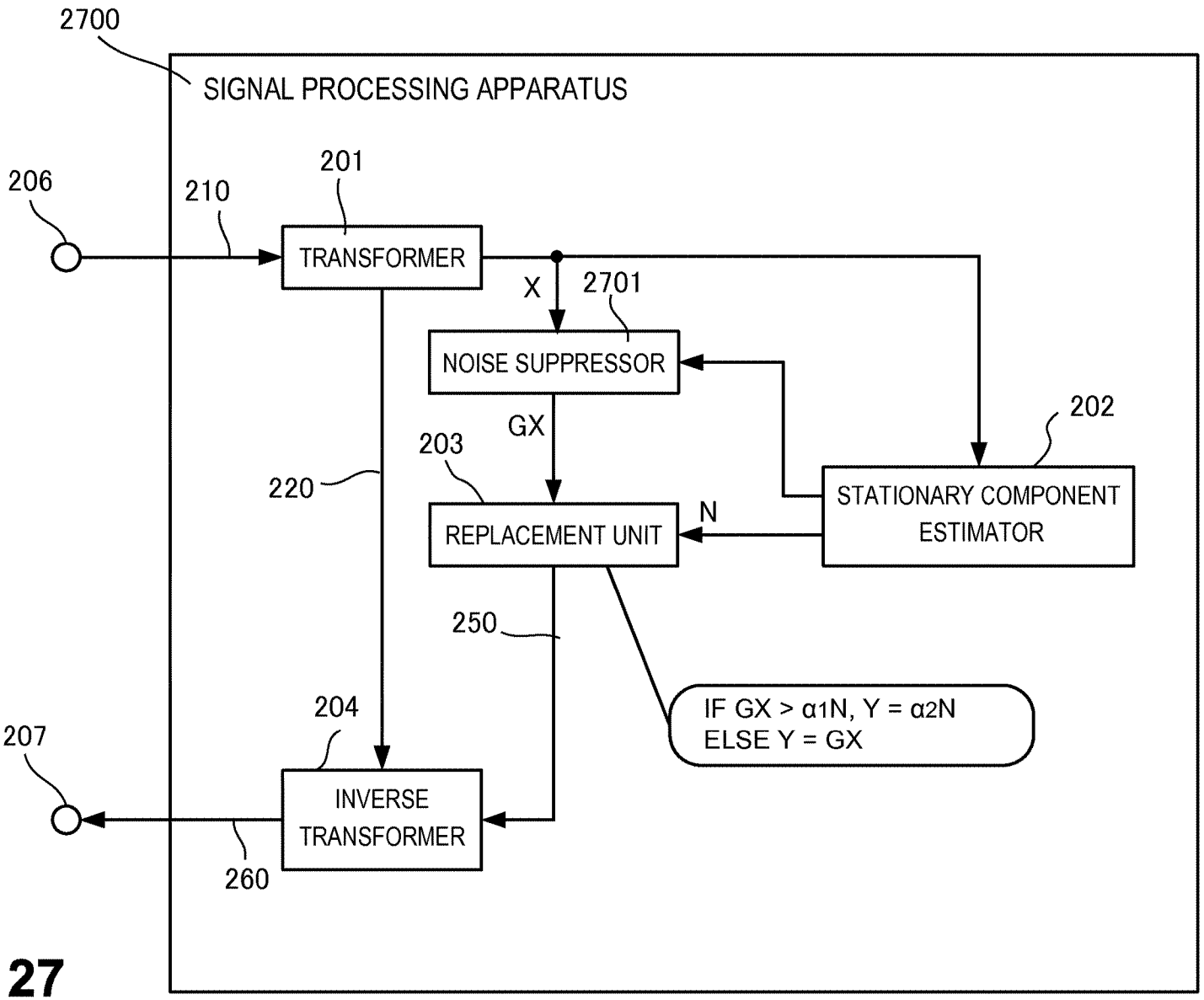
FIG. 27 is a block diagram showing the arrangement of a signal processing apparatus according to the 15th embodiment of the present invention.

A signal processing apparatus according to the 15th embodiment of the present invention will be described with reference to FIGS. 27 and 28. FIG. 27 is a block diagram for explaining the arrangement of a signal processing apparatus 2700 according to this embodiment. The signal processing apparatus 2700 according to this embodiment is different from the second embodiment in that a noise suppressor 2701 is included and a replacement unit 203 replaces a noise suppression result. The rest of the components and operations is the same as in the second embodiment. Hence, the same reference numerals denote the same components and operations, and a detailed description thereof will be omitted.

The noise suppressor 2701 suppresses noise using a noisy signal amplitude spectrum $|X(k, n)|$ supplied from a transformer 201 and a stationary component spectrum $N(k, n)$ estimated by a stationary component estimator 202, and transmits an enhanced signal amplitude spectrum $G(k, n)|X(k, n)|$ to the replacement unit 203 as a noise suppression result.

If $G(k, n)|X(k, n)|>\alpha 1(k, n)N(k, n)$, the replacement unit 203 sets $|Y(k, n)|=\alpha 2(k, n)N(k, n)$; otherwise, the replacement unit 203 sets $|Y(k, n)|=G(k, n)|X(k, n)|$.

Figure 28:
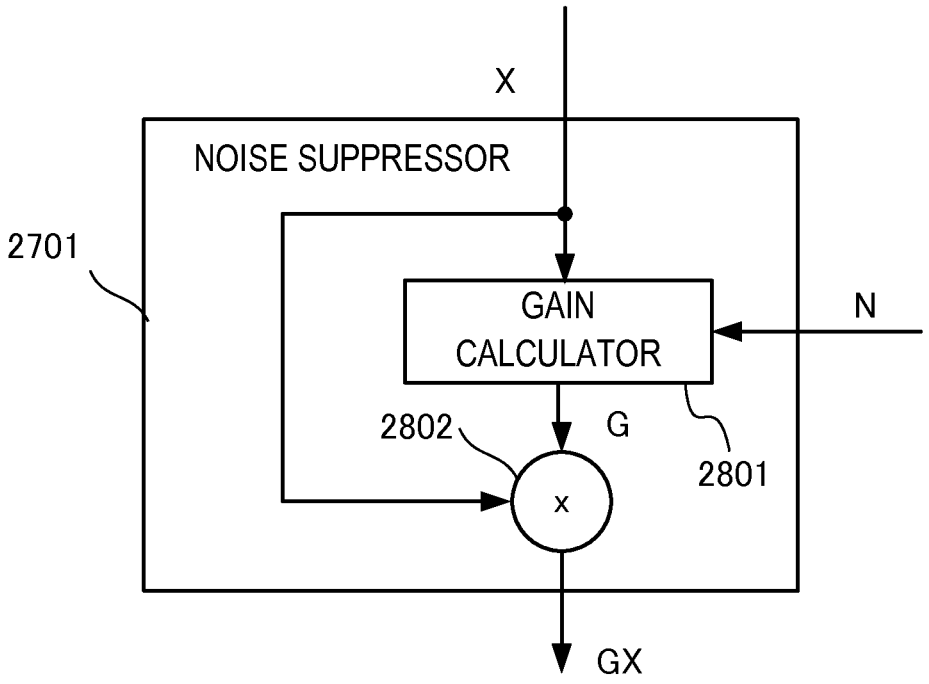
FIG. 28 is a block diagram showing the arrangement of a noise suppressor according to the 15th embodiment of the present invention.

FIG. 28 is a block diagram for explaining an example of the internal arrangement of the noise suppressor 2701. By using various methods, a gain calculator 2801 can obtain a gain $G(k, n)$ for suppressing noise. A Wiener filter for outputting an optimum estimated value which minimizes a mean square error with a desired signal may be used to obtain a gain. Alternatively, a known method such as GSS (Generalized Spectral Subtraction), MMSE STSA (Minimum Mean-Square Error Short-Time Spectral Amplitude), or MMSE LSA (Minimum Mean-Square Error Log Spectral Amplitude) may be used to derive a gain.

A multiplier 2802 obtains the enhanced signal amplitude spectrum $G(k, n)|X(k, n)|$ by multiplying the input signal $|X(k, n)|$ by the gain $G(k, n)$ obtained by the gain calculator 2801. The replacement unit 203 replaces the enhanced signal amplitude spectrum $G(k, n)|X(k, n)|$ by a multiple of a coefficient $\alpha(k, n)$ of the stationary component spectrum $N(k, n)$ in accordance with a condition.

According to this embodiment, it is possible to make a signal after noise suppression stationary in accordance with a condition, and suppress other noise while effectively suppressing noise such as wind noise with a strong non-stationary component.

16th Embodiment

Figure 29:
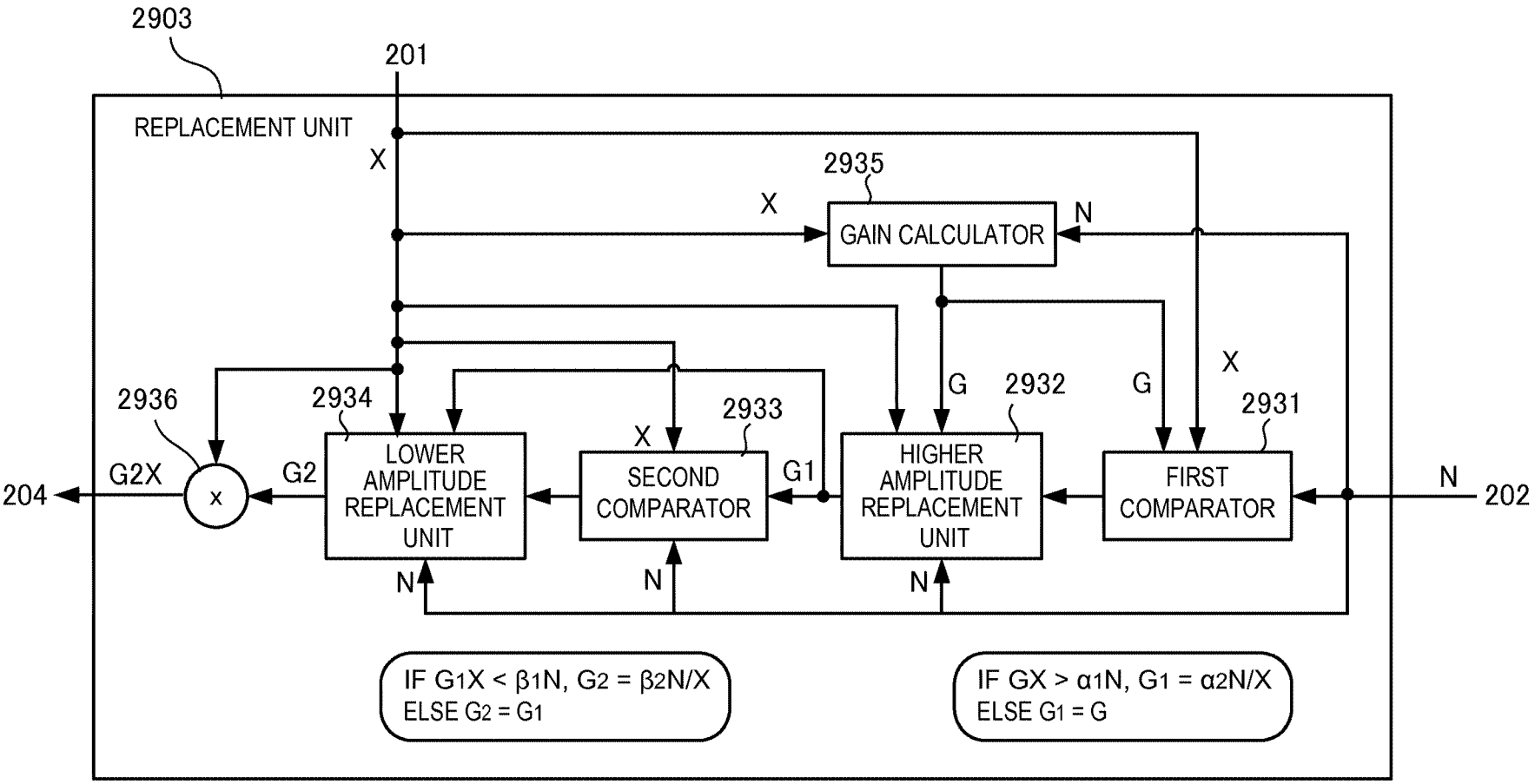
FIG. 29 is a block diagram showing the arrangement of a replacement unit according to the 16th embodiment of the present invention.

A signal processing apparatus according to the 16th embodiment of the present invention will be described with reference to FIG. 29. FIG. 29 is a block diagram for explaining the arrangement of a replacement unit 2903 according to this embodiment. The replacement unit 2903 according to this embodiment is different from the second embodiment in that a first comparator 2931, a higher amplitude replacement unit 2932, a second comparator 2933, a lower amplitude replacement unit 2934, and a gain calculator 2935 are included. The rest of the components and operations is the same as in the second embodiment. Hence, the same reference numerals denote the same components and operations, and a detailed description thereof will be omitted.

In this embodiment, in the replacement unit 2903, non-stationary noise is suppressed by replacement while suppressing noise using a gain.

The gain calculator 2935 calculates a gain $G(k, n)$ using a noisy signal amplitude spectrum $|X(k, n)|$ supplied from a transformer 201 and a stationary component spectrum $N(k, n)$ estimated by a stationary component estimator 202. This calculation method may use a known noise suppression technique, similarly to the 15th embodiment.

The first comparator 2931 compares $G(k, n)|X(k, n)|$ with $\alpha 1(k, n)N(k, n)$. If $G(k, n)|X(k, n)|>\alpha 1(k, n)N(k, n)$, the higher amplitude replacement unit 2932 sets $G1(k, n)=\alpha 2(k, n)N(k, n)/|X(k, n)|$; otherwise, the higher amplitude replacement unit 2932 sets $G1(k, n)=G(k, n)$.

On the other hand, the second comparator 2933 compares G1(k, n)X(k, n) with β1(k, n)N(k, n). If G1(k, n)X(k, n)<β1(k, n)N(k, n), the lower amplitude replacement unit 2934 sets G2(k, n)=β2(k, n)N(k, n)/X(k, n); otherwise, the lower amplitude replacement unit 2934 sets G2(k, n)=G1(k, n).

Lastly, a multiplier 2936 multiplies the input amplitude spectrum |X(k, n)| by the gain G2(k, n), and outputs a replaced new amplitude spectrum G2(k, n)|X(k, n)|.

As described above, when the replacement unit 2903 performs gain calculation, and performs replacement processing using a gain, it is possible to make a signal after noise suppression stationary in accordance with a condition, and suppress other noise while effectively suppressing noise such as wind noise with a strong non-stationary component.

17th Embodiment

Figure 30:
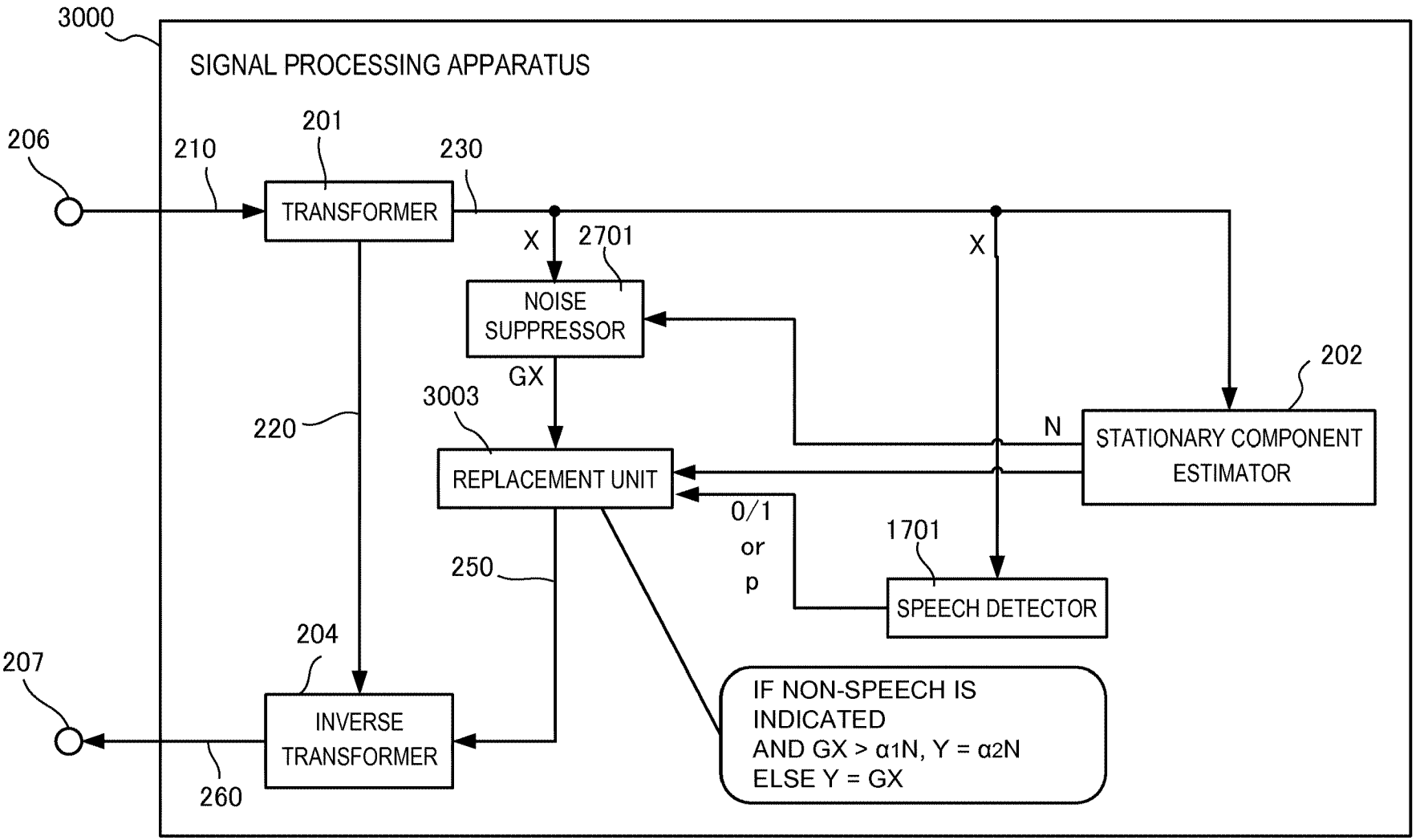
FIG. 30 is a block diagram showing the arrangement of a signal processing apparatus according to the 17th embodiment of the present invention.

A signal processing apparatus according to the 17th embodiment of the present invention will be described with reference to FIG. 30. FIG. 30 is a block diagram for explaining the arrangement of a signal processing apparatus 3000 according to this embodiment. The signal processing apparatus 3000 according to this embodiment is different from the 15th embodiment in that a speech detector 1701 described with reference to FIG. 17 is further included. The rest of the components and operations is the same as in the 15th embodiment. Hence, the same reference numerals denote the same components and operations, and a detailed description thereof will be omitted.

In accordance with a speech detection result (0/1 or speech presence probability p) by the speech detector 1701, a replacement unit 3003 replaces a noise suppression result G(k, n)|X(k, n)| by a noise suppressor by a multiple of a coefficient α(k, n) of a stationary component signal N(k, n) from a stationary component estimator 202. The replacement unit 3003 may have the arrangement described in each of the ninth to 14th embodiments.

In addition, for example, a noise suppressor 2701 may calculate an MMSE STSA gain function value G(k, n) for each frequency band based on a speech presence probability p(k, n) output from the speech detector 1701 by using the technique described in patent literature 3, multiply an input signal |X(k, n)| by the MMSE STSA gain function value, and obtain an enhanced signal G(k, n)|X(k, n)|, thereby outputting the enhanced signal to the replacement unit 3003.

According to this embodiment, it is possible to make signal after noise suppression stationary in accordance with a speech detection result, and output clear speech while effectively suppressing noise such as wind noise with a strong non-stationary component and other noise.

Other Embodiments

The signal processing apparatus according to each of the above-described embodiments is applicable to suppression of wind noise at the time of video shooting or voice recording, a vehicle passing sound (car/bullet train), a helicopter sound, noise on the street, cafeteria noise, office noise, the rustle of a dress, and the like. Note that the present invention is not limited to this, and is applicable to any signal processing apparatus required to suppress a non-stationary noise from an input signal.

Note that the present invention is not limited to the above-described embodiments. The arrangement and details of the present invention can variously be modified without departing from the spirit and scope thereof, as will be understood by those skilled in the art. The present invention also incorporates a system or apparatus that combines different features included in the embodiments in any form.

The present invention may be applied to a system including a plurality of devices or a single apparatus. The present invention is also applicable even when a signal processing program for implementing the functions of the embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program. In particular, the present invention incorporates a non-transitory computer readable medium storing a program for causing a computer to execute processing steps included in the above-described embodiments.

Figure 31:
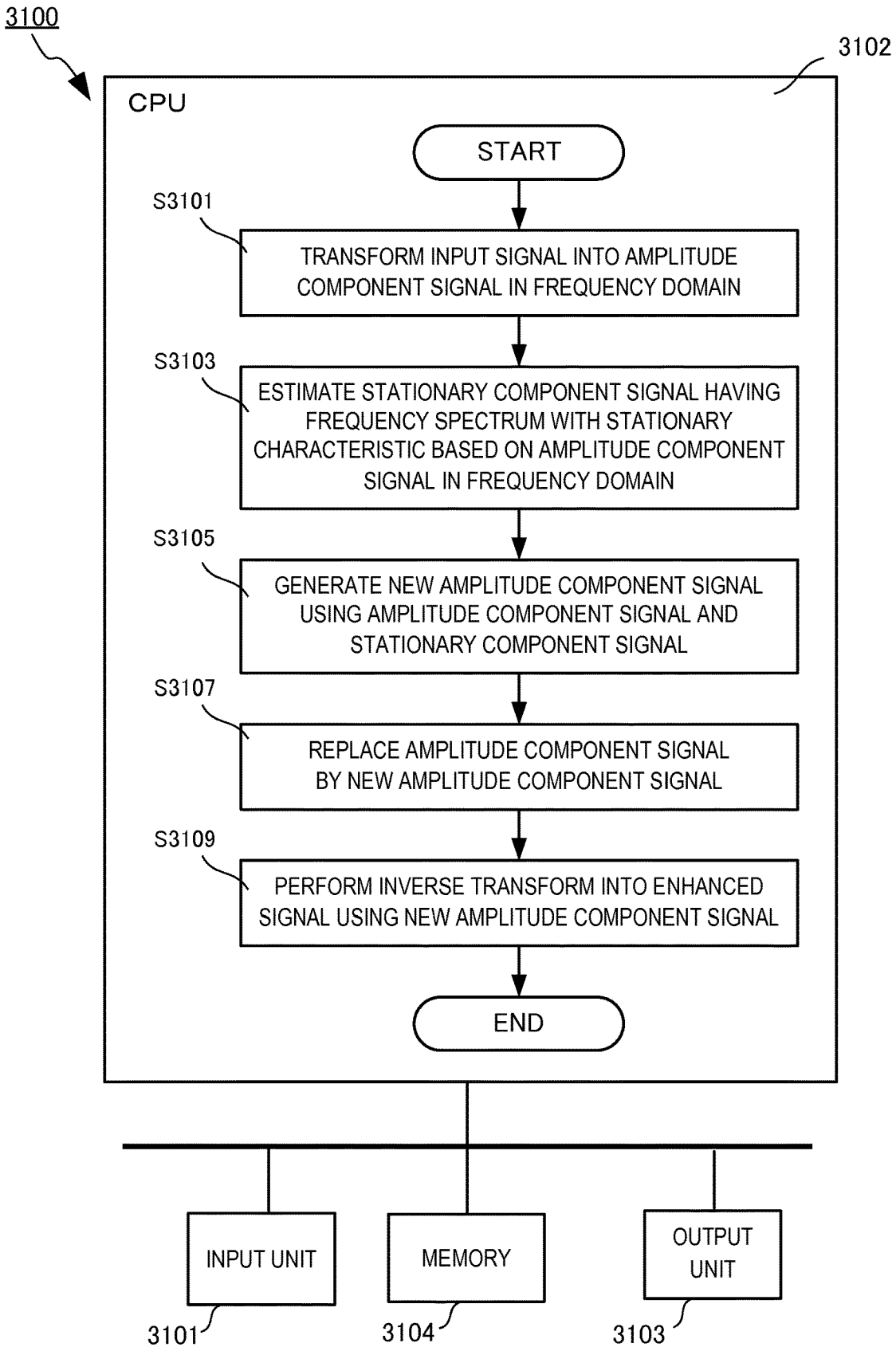
FIG. 31 is a block diagram showing an arrangement when a signal processing apparatus according to the embodiments of the present invention is implemented by software.

As an example, a processing procedure executed by a CPU 3102 provided in a computer 3100 when the speech processing explained in the first embodiment is implemented by software will be described below with reference to FIG. 31.

An input signal is transformed into an amplitude component signal in the frequency domain (S3101). Based on the amplitude component signal in the frequency domain, a stationary component signal having a frequency spectrum with a stationary characteristic is estimated (S3103). A new amplitude component signal is generated using the input amplitude component signal and the stationary component signal (S3105). The amplitude component signal is replaced by the new amplitude component signal (S3107). In addition, the new amplitude component signal is inversely transformed into an enhanced signal (S3109).

Program modules for executing these processes are stored in a memory 3104. When the CPU 3102 sequentially executes the program modules stored in the memory 3104, it is possible to obtain the same effects as those in the first embodiment.

Similarly, as for the second to 17th embodiments, when a CPU 3102 executes program modules corresponding to the functional components described with reference to the block diagrams from the memory 3104, it is possible to obtain the same effects as those in the embodiments.

[Other Expressions of Embodiments]

Some or all of the above-described embodiments can also be described as in the following supplementary notes but are not limited to the followings.

(Supplementary Note 1)

There is provided a signal processing apparatus comprising:

a transformer that transforms an input signal into an amplitude component signal in a frequency domain;

a stationary component estimator that estimates a stationary component signal having a frequency spectrum with a stationary characteristic based on the amplitude component signal in the frequency domain;

a replacement unit that generates a new amplitude component signal using the amplitude component signal obtained by the transformer and the stationary component signal, and replaces the amplitude component signal by the new amplitude component signal; and an inverse transformer that inversely transforms the new amplitude component signal into an enhanced signal.

(Supplementary Note 2)

There is provided the signal processing apparatus according to supplementary note 1, wherein the replacement unit generates the new amplitude component signal based on a function of the stationary component signal at at least some frequencies.

(Supplementary Note 3)

There is provided the signal processing apparatus according to supplementary note 1 or 2, wherein the replacement unit generates the new amplitude component signal by multiplying the stationary component signal by a coefficient at at least some frequencies.

(Supplementary Note 4)

There is provided the signal processing apparatus according to supplementary note 1, 2, or 3, wherein the replacement unit generates the new amplitude component signal based on a second function of the stationary component signal at a frequency at which the amplitude component signal is larger than a first threshold determined based on a first function of the stationary component signal.

(Supplementary Note 5)

There is provided the signal processing apparatus according to supplementary note 4, wherein the replacement unit includes a comparator that compares the first threshold and the amplitude component signal, and a higher amplitude replacement unit that generates the new amplitude component signal based on the second function of the stationary component signal at a frequency at which the amplitude component signal is larger than the first threshold, and directly obtains, as the new amplitude component signal, the amplitude component signal obtained by the transformer at a frequency at which the amplitude component signal is not larger than the first threshold.

(Supplementary Note 6)

There is provided the signal processing apparatus according to supplementary note 4, wherein the replacement unit includes a comparator that compares the amplitude component signal with a multiple, serving as the first threshold, of a first coefficient of the stationary component signal, and a higher amplitude replacement unit that obtains, as the new amplitude component signal, a multiple, serving as the second function, of a second coefficient of the stationary component signal when the amplitude component signal is larger than the multiple of the first coefficient of the stationary component signal, and directly obtains, as the new amplitude component signal, the amplitude component signal obtained by the transformer when the amplitude component signal is not larger than the multiple of the first coefficient of the stationary component signal.

(Supplementary Note 7)

There is provided the signal processing apparatus according to any one of supplementary notes 1 to 6, wherein the replacement unit generates the new amplitude component signal based on a fourth function of the stationary component signal at a frequency at which the amplitude component signal is smaller than a second threshold determined based on a third function of the stationary component signal.

(Supplementary Note 8)

There is provided the signal processing apparatus according to any one of supplementary notes 1 to 7, wherein the replacement unit includes a comparator that compares the second threshold and the amplitude component signal, and a higher amplitude replacement unit that generates the new amplitude component signal based on the second function of the stationary component signal at a frequency at which the amplitude component signal is larger than the second threshold, and directly obtains, as the new amplitude component signal, the amplitude component signal obtained by the transformer at a frequency at which the amplitude component signal is not larger than the second threshold.

(Supplementary Note 9)

There is provided the signal processing apparatus according to supplementary note 7, wherein the replacement unit includes a comparator that compares the amplitude component signal with a multiple, serving as the second threshold, of a third coefficient of the stationary component signal, and a lower amplitude replacement unit that obtains, as the new amplitude component signal, a multiple of a fourth coefficient of the stationary component signal when the amplitude component signal is smaller than the multiple of the third coefficient of the stationary component signal, and directly obtains, as the new amplitude component signal, the amplitude component signal obtained by the transformer when the amplitude component signal is not smaller than the multiple of the third coefficient of the stationary component signal.

(Supplementary Note 10)

There is provided the signal processing apparatus according to any one of supplementary notes 1 to 9, wherein the replacement unit generates the new amplitude component signal based on a sixth function of the stationary component signal at a frequency at which the amplitude component signal is larger than a third threshold determined based on a fifth function of the stationary component signal, and replaces the amplitude component signal by the new amplitude component signal, and generates the new amplitude component signal based on an eighth function of the stationary component signal at a frequency at which the amplitude component signal is smaller than a fourth threshold determined based on a seventh function of the stationary component signal, and replaces the amplitude component signal by the new amplitude component signal, and the third threshold is not smaller than the fourth threshold.

(Supplementary Note 11)

There is provided the signal processing apparatus according to supplementary note 10, wherein the replacement unit includes a first comparator that compares the amplitude component signal with a multiple, serving as the third threshold, of a fifth coefficient of the stationary component signal, a higher amplitude replacement unit that replaces the amplitude component signal using a multiple of a sixth coefficient of the stationary component signal as the new amplitude component signal when the amplitude component signal is larger than the multiple of the fifth coefficient of the stationary component signal, and directly obtains, as the new amplitude component signal, the amplitude component signal obtained by the transformer when the amplitude component signal is not larger than the multiple of the fifth coefficient of the stationary component signal, a second comparator that compares the multiple, serving as the fourth threshold, of the sixth coefficient of the stationary component signal with the new amplitude component signal output from the higher amplitude replacement unit, and a lower amplitude replacement unit that further replaces the new amplitude component signal obtained by the higher amplitude replacement unit using a multiple of a seventh coefficient of the stationary component signal when the new amplitude component signal output from the higher amplitude replacement unit is smaller than the multiple of the sixth coefficient of the stationary component signal, and directly outputs the new amplitude component signal obtained by the higher amplitude replacement unit when the amplitude component signal is not smaller than the multiple of the sixth coefficient of the stationary component signal.

(Supplementary Note 12)

There is provided the signal processing apparatus according to supplementary note 1, wherein the replacement unit includes a comparator that compares the amplitude component signal with a multiple of a seventh coefficient of the stationary component signal, and a higher amplitude replacement unit that replaces the amplitude component signal using a multiple of an eighth coefficient of the amplitude component signal as the new amplitude component signal when the amplitude component signal is larger than the multiple of the seventh coefficient of the stationary component signal, and directly obtains, as the new amplitude component signal, the amplitude component signal obtained by the transformer when the amplitude component signal is not larger than the multiple of the seventh coefficient of the stationary component signal.

(Supplementary Note 13)

There is provided the signal processing apparatus according to supplementary note 1, wherein the replacement unit includes a first comparator that compares the amplitude component signal with a multiple of a ninth coefficient of the stationary component signal, a higher amplitude replacement unit that replaces the amplitude component signal using a multiple of a 10th coefficient of the amplitude component signal as the new amplitude component signal when the amplitude component signal is larger than the multiple of the ninth coefficient of the stationary component signal, and directly obtains, as the new amplitude component signal, the amplitude component signal obtained by the transformer when the amplitude component signal is not larger than the multiple of the ninth coefficient of the stationary component signal, a second comparator that compares the new amplitude component signal output from the higher amplitude replacement unit with a multiple of an 11th coefficient of the stationary component signal, and a lower amplitude replacement unit that further replaces the new amplitude component signal obtained by the higher amplitude replacement unit using a multiple of a 12th coefficient of the stationary component signal when the amplitude component signal is smaller than the multiple of the 11th coefficient of the stationary component signal, and outputs the new amplitude component signal obtained by the higher amplitude replacement unit when the amplitude component signal is not smaller than the multiple of the 11th coefficient of the stationary component signal.

(Supplementary Note 14)

There is provided the signal processing apparatus according to any one of supplementary notes 1 to 13, further comprising:

a speech detector that detects speech from the amplitude component signal, wherein the replacement unit replaces the amplitude component signal obtained by the transformer in a non-speech section.

(Supplementary Note 15)

There is provided the signal processing apparatus according to any one of supplementary notes 1 to 13, further comprising:

a speech detector that generates a speech presence probability from the amplitude component signal, wherein the replacement unit replaces the amplitude component signal obtained by the transformer so that the amplitude component signal becomes closer to the stationary component signal as the speech presence probability is lower in the frequency domain.

(Supplementary Note 16)

There is provided the signal processing apparatus according to any one of supplementary notes 1 to 15, further comprising:

a noise suppressor that suppresses noise included in the amplitude component signal, wherein the replacement unit generates a new amplitude component signal using the stationary component signal and an enhanced amplitude component signal obtained by the noise suppressor, and replaces the amplitude component signal by the new amplitude component signal.

(Supplementary Note 17)

There is provided a signal processing method comprising:

transforming an input signal into an amplitude component signal in a frequency domain;

estimating a stationary component signal having a frequency spectrum with a stationary characteristic based on the amplitude component signal in the frequency domain;

generating a new amplitude component signal using the amplitude component signal obtained in the transform and the stationary component signal, and replacing the amplitude component signal by the new amplitude component signal; and inversely transforming the new amplitude component signal into an enhanced signal.

(Supplementary Note 18)

There is provided a signal processing program for causing a computer to execute a method, comprising:

transforming an input signal into an amplitude component signal in a frequency domain;

estimating a stationary component signal having a frequency spectrum with a stationary characteristic based on the amplitude component signal in the frequency domain;

generating a new amplitude component signal using the amplitude component signal obtained in the transform and the stationary component signal, and replacing the amplitude component signal by the new amplitude component signal; and inversely transforming the new amplitude component signal into an enhanced signal.

This application claims the benefit of Japanese Patent Application No. 2013-83411 filed on Apr. 11, 2013, which is hereby incorporated by reference herein in its entirety.

What is claimed is:

1. A signal processing apparatus comprising:

a transformer that transforms an input signal into input amplitude components in a frequency domain;

a stationary component estimator that estimates stationary amplitude components having a stationary frequency spectrum based on the input amplitude components;

a replacement unit that generates new amplitude components using the input amplitude components and the stationary amplitude components, and replaces the input amplitude components by the new amplitude components to generate output amplitude components when the input amplitude components and the stationary amplitude components satisfy a predetermined condition; and an inverse transformer that inversely transforms the output amplitude components into an enhanced signal, wherein said replacement unit includes:

a first comparator that compares the input amplitude components and the stationary components multiplied by a first upper scale factor, an upper-side replacement unit that takes the stationary components multiplied by a second upper scale factor as the new amplitude components when the input amplitude components are larger than the stationary components multiplied by the first upper scale factor, and keeps, as the new amplitude components, the input amplitude components otherwise, a second comparator that compares the stationary components multiplied by a first lower-side scale factor with the new amplitude components output from said upper-side replacement unit, and a lower-side replacement unit that further replaces the new amplitude components obtained by said upper-side replacement unit using the stationary components multiplied by a first lower-side scale factor when the new amplitude components output from said upper-side replacement unit are smaller than the stationary components multiplied by a second lower-side scale factor, and keeps the new amplitude components obtained by said upper-side replacement unit otherwise.

2. A signal processing apparatus comprising:

a transformer that transforms an input signal into input amplitude components in a frequency domain;

a stationary component estimator that estimates stationary amplitude components having a stationary frequency spectrum based on the input amplitude components;

a replacement unit that generates new amplitude components signal using the input amplitude components and the stationary amplitude components, and replaces the input amplitude components by the new amplitude components to generate output amplitude components when the input amplitude components and the stationary amplitude components satisfy a predetermined condition; and an inverse transformer that inversely transforms the output amplitude components into an enhanced signal, wherein said replacement unit includes a first comparator that compares the input amplitude components with the stationary components multiplied by a first scale factor, an upper-side replacement unit that takes the input amplitude components multiplied by a second scale factor as the new amplitude components when the input amplitude components are larger than the stationary components multiplied by a first scale factor, and keeps, as the new amplitude components, the input amplitude components otherwise, a second comparator that compares the new amplitude components output from said upper-side replacement unit the stationary components multiplied by a third scale factor, and a lower-side replacement unit that further replaces the new amplitude components obtained by said upper-side replacement unit using the stationary components multiplied by a fourth scale factor when the input amplitude components are smaller than the stationary components multiplied by a third scale factor, and outputs the new amplitude components obtained by said upper-side replacement unit otherwise.

3. The signal processing apparatus according to claim 1, further comprising:

a speech detector that detects speech from the input amplitude components, wherein said replacement unit replaces the input amplitude components in non-speech sections.

4. The signal processing apparatus according to claim 1, further comprising:

a speech detector that generates a speech presence probability from the input amplitude components, wherein said replacement unit replaces the input amplitude components so that the input amplitude components become closer to the stationary components as the speech presence probability is lower in the frequency domain.

5. The signal processing apparatus according to claim 1, further comprising:

a noise suppressor that suppresses noise included in the input amplitude components, wherein said replacement unit generates new amplitude components using the stationary components and enhanced amplitude components obtained by said noise suppressor, and replaces the input amplitude components by the new amplitude components.

6. A signal processing method comprising:

a transforming step of transforming an input signal into amplitude components in a frequency domain;

an estimating step of estimating stationary components having a stationary frequency spectrum based on the input amplitude components;

a generating step of generating, by a replacement unit, new amplitude components using the input amplitude components or the stationary components, and replacing the input amplitude components by the new amplitude components to generate output amplitude components when the input amplitude components and the stationary amplitude components satisfy a predetermined condition; and an inversely transforming step of inversely transforming the amplitude components into an enhanced signal, wherein the replacement unit includes:

a first comparator that compares the input amplitude components and the stationary components multiplied by a first upper scale factor, an upper-side replacement unit that takes the stationary components multiplied by a second upper scale factor as the new amplitude components when the input amplitude components are larger than the stationary components multiplied by the first upper scale factor, and keeps, as the new amplitude components, the input amplitude components otherwise, a second comparator that compares the stationary components multiplied by a first lower-side scale factor with the new amplitude components output from said upper-side replacement unit, and a lower-side replacement unit that further replaces the new amplitude components obtained by said upper-side replacement unit using the stationary components multiplied by a first lower-side scale factor when the new amplitude components output from said upper-side replacement unit are smaller than the stationary components multiplied by a second lower-side scale factor, and keeps the new amplitude components obtained by said upper-side replacement unit otherwise.

7. A non-transitory computer readable medium storing a signal processing program for causing a computer to execute a method, comprising:

a transforming step of transforming an input signal into amplitude components in a frequency domain;

an estimating step of estimating stationary components having a stationary frequency spectrum based on the input amplitude components;

a generating step of generating, by a replacement unit, new amplitude components using the input amplitude components or the stationary components, and replacing the input amplitude components by the new amplitude components to generate output amplitude components when the input amplitude components and the stationary amplitude components satisfy a predetermined condition; and an inversely transforming step of inversely transforming the amplitude components into an enhanced signal, wherein the replacement unit includes:

a first comparator that compares the input amplitude components and the stationary components multiplied by a first upper scale factor, an upper-side replacement unit that takes the stationary components multiplied by a second upper scale factor as the new amplitude components when the input amplitude components are larger than the stationary components multiplied by the first upper scale factor, and keeps, as the new amplitude components, the input amplitude components otherwise, a second comparator that compares the stationary components multiplied by a first lower-side scale factor with the new amplitude components output from said upper-side replacement unit, and a lower-side replacement unit that further replaces the new amplitude components obtained by said upper-side replacement unit using the stationary components multiplied by a first lower-side scale factor when the new amplitude components output from said upper-side replacement unit are smaller than the stationary components multiplied by a second lower-side scale factor, and keeps the new amplitude components obtained by said upper-side replacement unit otherwise.

* * * * *